US012503651B2

(12) United States Patent
Nielsen

(10) Patent No.: US 12,503,651 B2
(45) Date of Patent: Dec. 23, 2025

(54) METHODS FOR PRODUCTION OF BIO-CRUDE OIL

(71) Applicant: Kvasir Technologies ApS c/o Alfa Laval, Søborg (DK)

(72) Inventor: Joachim Bachmann Nielsen, Copenhagen K (DK)

(73) Assignee: KVASIR TECHNOLOGIES APS C/O ALFA LAVAL (DK)

( * ) Notice: Subject to any disclaimer, the term of this patent is extended or adjusted under 35 U.S.C. 154(b) by 388 days.

(21) Appl. No.: 17/995,879

(22) PCT Filed: Apr. 15, 2021

(86) PCT No.: PCT/EP2021/059794

§ 371 (c)(1),
(2) Date: Oct. 10, 2022

(87) PCT Pub. No.: WO2021/209555

PCT Pub. Date: Oct. 21, 2021

(65) Prior Publication Data

US 2023/0212463 A1 Jul. 6, 2023

Related U.S. Application Data

(60) Provisional application No. 63/122,475, filed on Dec. 8, 2020, provisional application No. 63/010,079, filed on Apr. 15, 2020.

(51) Int. Cl.
*C10G 1/00* (2006.01)

(52) U.S. Cl.
CPC ..... *C10G 1/002* (2013.01); *C10G 2300/1014* (2013.01); *C10G 2300/4006* (2013.01)

(58) Field of Classification Search
CPC ..... C10G 1/002; C10G 2300/1014; C10G 2300/4006; C10G 1/065; C10G 2300/301;
(Continued)

(56) References Cited

U.S. PATENT DOCUMENTS 4,759,841 A 7/1988 Flodin
7,425,657 B1 9/2008 Elliott et al.
(Continued)

FOREIGN PATENT DOCUMENTS

CA 3174184 A1 10/2021
WO 2017219151 A1 12/2017

OTHER PUBLICATIONS

Huamin, Liu; Xin'an, Xie; Nianping, Ding; Luyi, Huang, Liquefaction Reaction Pathway and Mechanism of Cornstalk in Sub- and Super-Critical Ethanol, Transactdion of the CSAE, China, 2010, vol. 26, No. 2, pp. 277-282.
(Continued)

*Primary Examiner* — James C Goloboy
*Assistant Examiner* — Francis C Campanell
(74) *Attorney, Agent, or Firm* — Luedeka Neely, P.C.

(57) ABSTRACT

Where thermochemical liquefaction of lignocellulosic biomass is conducted using recirculated product oil as solvent, yields can be substantially increased by addition of a short chain alcohol reactant such as ethanol or methanol. A synergistic effect is thereby obtained where liquefaction is improved over using either recycled product oil or alcohol alone. The combination of re-circulated product oil and alcohol reactant permits high conversion at operating pressures considerably lower than typically applied in alcohol solvolysis, typically within the range 30-60 bar. The liquefaction reaction occurs at subcritical pressure where the alcohol acts as a gaseous reactant and not as a solvent.

23 Claims, 14 Drawing Sheets

(58) Field of Classification Search
CPC .... C10G 2300/4012; C10G 2300/4018; C10G 2300/4081; C10G 2300/44; Y02P 30/20
USPC ..... 585/242
See application file for complete search history.

(56) References Cited

U.S. PATENT DOCUMENTS

| | | | | |
|---|---|---|---|---|
| 10,273,413 | B2 | 4/2019 | Nielsen et al. | |
| 11,306,264 | B2 | 4/2022 | Felby et al. | |
| 2013/0276361 | A1* | 10/2013 | Maschmeyer | C10G 1/083 208/430 |
| 2014/0128646 | A1 | 5/2014 | Iversen | |
| 2014/0371496 | A1 | 12/2014 | Stevens, Jr. et al. | |
| 2019/0134597 | A1 | 5/2019 | Iversen | |
| 2020/0071619 | A1 | 3/2020 | Humphreys et al. | |
| 2020/0283684 | A1 | 9/2020 | Kouris et al. | |

OTHER PUBLICATIONS

Bazaev, A., Abdulagatov, I. M., Bazaev, E. A., Abdurashidova, A., "PVT measurements for pure ethanol in the near-critical and supercritical regions," International Journal of Thermophysics (2007) 28(1):pp. 194-219.

Belkheiri, T., Anderson, S., Mattsson, C., Olausson, L., Theliander, H., Vamling, L., "Hydrothermal Liquefaction of Kraft Lignin in Subcritical Water: Influence of Phenol as Capping Agent," Energy Fuels (2018) 32: pp. 5923-5932.

Castello, D., Pedersen, T. H., Rosendahl, L. A., "Continuous Hydrothermal Liquefaction of Biomass: A Critical Review," Energies (2018) 11, 3165, pp. 1-35.

Jensen, C., Guerrero, J. K. R., Karatzos, S., Olofsson, G., Iversen, S. B., "Fundamentals of HydrofactionTM: Renewable crude oil from woody biomass," Biomass Conv. Bioref. (2017) 7: pp. 495-509.

Nielsen, J. B., Jensen, A., Schandel, C. B., Felby, C., Jensen, A. D., "Solvent consumption in non-catalytic alcohol solvolysis of biorefinery lignin," Sustainable Energy Fuels, 2017, 1, pp. 2006-2015.

Pang, S. "Advances in thermochemical conversion of woody biomass to energy, fuels and chemicals," Biotechnology Advances (2019) 37: pp. 589-597.

* cited by examiner

Effect of various reaction conditions on reaction pressure at 350C

Effect of amount of ethanol added on product yields

Effect of ethanol density on liquefaction performance

Effect of amount of ethanol added on product yields

Effect of amount of ethanol added on the elemental composition of oil

Effect of different model compounds added as "recycle oil" in the presence of ethanol

Effect of various combinations with Anisole

Effect of various combinations with Tar

Effect of various combinations with real recycled oil

Effect of amount of biomass added on product yields

Effect of degree of lignin loading on product yields

Effect of residence time on product yields when using 1g pine wood

Effect of residence time on product yields when using 3g pine wood

Effect of reaction time, 2h (A) vs. 1h (B), for two experiments with recycled oil, ethanol and biomass.

Effect different feedstocks (pine wood and wheat straw) on product yields

Effect of different feedstocks (pine wood and lignin) on product yields

Effect of feedstock biomass (lignin vs. pine vs. birch) on elemental composition of oil

Effect of feedstock biomass (lignin vs. pine vs. birch) on product yields

Effect of lignin-oil HDO on upgraded product oil composition

Effect of HDO on Decane solvent composition

Effect of wood-oil HDO at different reaction temperatures on upgraded product oil composition

Comparison of product oil composition after HDO of lignin-oil and wood-oil at similar conditions

One embodiment of a system suitable for practicing methods of the invention

METHODS FOR PRODUCTION OF BIO-CRUDE OIL

TECHNICAL FIELD

The invention relates in general to thermochemical processing of lignocellulosic biomass and in particular to methods for production of bio-crude oil involving re-circulation of product oil.

Thermochemical liquefaction of biomass is widely known in the art, both for producing bio-crude oil and also as a means of fractionation permitting separate recovery of valuable components. (For review see Huang 2015, Belkheiri 2018, Castello 2018, Pang 2019) Many different types of biomass have been treated by thermochemical liquefaction using many different sub-critical or super-critical solvents including primarily aqueous solvents, or non-aqueous, or a mixture of aqueous and non-aqueous co-solvents.

It is generally accepted that thermochemical liquefaction can be advantageously practiced using a slurry having the highest practicable biomass concentration that is "pumpable." Re-circulation of both product oil and aqueous phase in aqueous thermochemical liquefaction imparts well known advantages, including increasing "pumpability" of the biomass input feed. (See Jensen 2017).

In cases where the biomass feedstock has low water content, a separate aqueous phase can be avoided altogether. Where the aim is production of bio-crude oil from lignocellulosic biomass feedstocks, rather than more elaborate fractionation, direct liquefaction can be advantageously achieved using a non-aqueous solvent consisting simply of re-circulated product oil.

Thermochemical liquefaction processes that rely on re-circulation of bio-crude product oil as the process solvent must typically introduce some "make-up solvent" to replace the stream of product oil that is removed at steady-state. In cases where the biomass feedstock has significant water content, the "make-up solvent" can simply be re-circulated aqueous product phase. In cases where the biomass feedstock is comparatively dry, the "make-up" solvent used in prior art processes has typically been an aromatic oil such as light cycle oil or other petroleum refinery side stream. Such aromatic oils were convenient in that they acted as hydrogen donor solvents and were, thereby, themselves altered in the process, ultimately imparting a quality of reduced viscosity to the product oil so as to render it more readily pumpable (i.e., easier to transport for further processing at a petroleum refinery). See WO2012/005784.

We have discovered that, surprisingly, in a thermochemical liquefaction process that relies on re-circulated product oil as the process solvent, bio-crude oil yield can be improved where a short-chain aliphatic alcohol reactant, which is typically consumed during the process, is included in the make-up solvent.

DETAILED DESCRIPTION OF EMBODIMENTS

Figure 1:
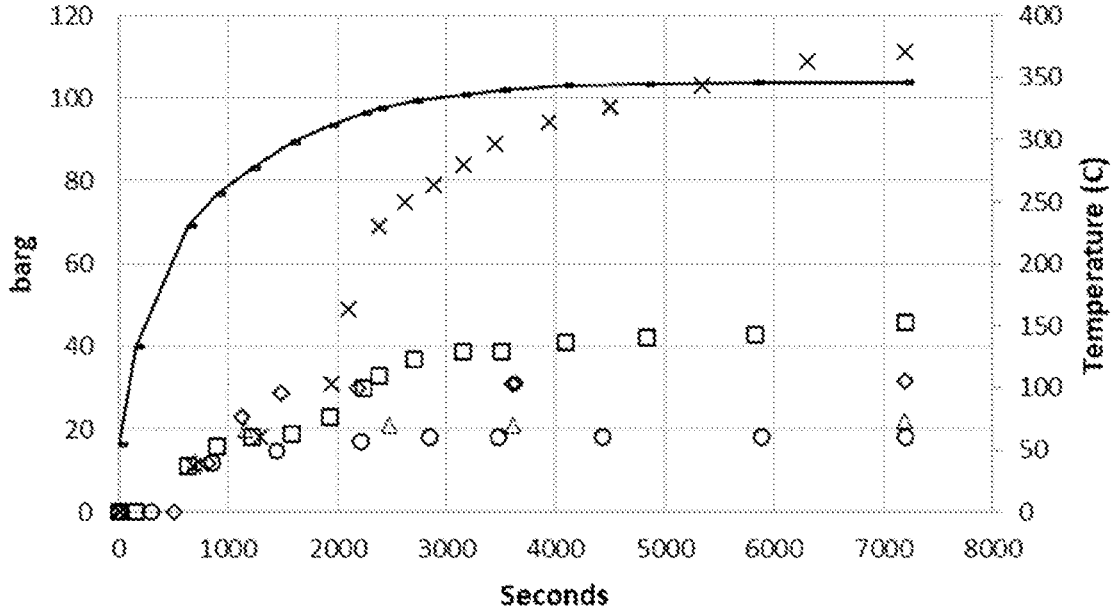
FIG. 1 Effect of various reaction conditions on reaction pressure at 350° C.

Addition of even comparatively small quantities of short chain alcohol to a biomass slurry formed from fresh feedstock and re-circulated product oil results in reduced char formation and improved bio-crude yield from thermal liquefaction.

In the prior art process known as "ethanol solvolysis," thermal liquefaction of biomass has been conducted in the presence of ethanol. The term "supercritical ethanol" has frequently been applied in reference to this process because of the high temperatures at which it is conducted. We previously presented evidence in WO2016/113280 that, in the context of biomass liquefaction, ethanol exists as a distinct phase in nominally supercritical conditions. Here we can report more clearly that under typical reaction conditions in ethanol liquefaction, ethanol is clearly subcritical and is not a "solvent" at all but rather a gaseous reactant.

In ethanol-liquefaction, the alcohol is consumed by three distinct primary pathways, as described in (J. B. Nielsen, A. Jensen, C. B. Schandel, C. Felby and A. D. Jensen, Solvent consumption in non-catalytic alcohol solvolysis of biorefinery lignin, Sustainable Energy Fuels, 2017, 1, 2006-2015), (1) direct thermal decomposition to gases, (2) reaction to form higher alcohols, ethers and esters, and (3) direct reaction with biomass fragments yielding oil species where the alcohol, or part of the alcohol molecule, is directly covalently attached to the product bio-oil molecules. Reaction (1) is disadvantageous, but can be limited by reducing residence time and reaction severity. Reaction (2) yields products of Guerbet and Cannizzaro/Tishchenko reaction. This is generally undesirable. However, products of this pathway are believed to ultimately assist in reducing char and improving oil yield since alcohols are also a product of these reactions. Reaction (3) is very desirable and the direct incorporation of alcohol by covalent bonding to bio-oil fragments/molecules is believed to be the reason for inhibition of char formation and improved oil yield, stability and lack of acidity. Alcohol can be incorporated in the form of C—C bonding, in the form of alcohol reactant derived ethers or esters.

The emerging "green" biofuels market is subject to considerable price volatility. Ironically, it is often the case that direct incorporation of ethanol mass into bio-crude oil can be, itself, a revenue positive process. But even where ethanol consumption imposes some process cost, addition of ethanol to the feedstock feedstream in thermal liquefaction provides net benefits by improving overall bio-crude oil yields.

Methods of the invention provide processes for liquefaction of biomass which comprise thermochemical treatment of a slurry formed from biomass feedstock and re-circulated product bio-oil, or a fraction thereof, to which is added an alcohol reactant that promotes liquefaction. The liquefaction reaction occurs in a reactive atmosphere of alcohol that is neither in a liquid state nor a supercritical state but in a subcritical state as defined by having a temperature above the critical temperature but a pressure below the critical pressure. At reaction conditions the alcohol reacts as alcohol vapors and not as a solvent. The alcohol can be dissolved in the mixture comprising of recycled product bio-oil and biomass.

In some embodiments, the invention provides a method for production of bio-crude oil comprising the steps of:

(i). Providing lignocellulosic biomass, and (ii). Subjecting said biomass to thermochemical treatment at temperature between 250 and 450° C. for residence time between 1 and 120 minutes as a slurry formed with re-circulated product oil obtained from previous thermochemical treatment of similar biomass to which is added a short-chain alcohol reactant in an amount corresponding to between 2% and 150% of the slurry dry weight, wherein the ratio of biomass to re-circulated product oil is within the range 1:1 and 1:5 w/w and the ratio of biomass to added alcohol is within the range 1:9 and 5:1 w/w.

In some embodiments, the invention provides a method of optimizing a continuous thermal liquefaction process comprising the step of:

(i). Providing a slurry formed with biomass and product oil obtained from previous thermochemical treatment of similar biomass as feedstream to a continuous thermal liquefaction system, and (ii). Determining an appropriate ratio of slurry to alcohol reactant added to the thermal liquefaction process that is sufficient to maintain an alcohol density of at least 17 kg/m3 within the thermal reactor of the thermal liquefaction system at steady state.

As used herein, the following terms have the following meaning:

"Bio-crude oil" refers to product oil obtained by a thermal liquefaction process.

"Bio-oil" is a broad term, which includes bio-crude oils, as well as pyrolysis oils.

"Effective amount of added catalyst" refers to a quantity of catalyst alone or in combination with one or more other catalysts sufficient to increase conversion yield or decrease O:C ratio of product oil by at least 15% in relative terms compared with the reaction conducted under equivalent conditions in the absence of added catalyst.

"Ethanol density within the thermal reactor of the thermal liquefaction system at steady state" refers to (the average value over one residence time in a continuous system at steady state of mass of ethanol within the thermal reactor portion of system) divided by (the volume of the thermal reactor portion of the system).

"Hydroprocessing" refers to reactions in the presence of a catalyst and hydrogen at elevated temperature and pressure, used for modification of organic materials (e.g. biomass, petroleum products, coal and the like). Typically, hydroprocessing provides a more volatile product, often a liquid. It can include hydrogenation, isomerization, deoxygenation, hydrodeoxygenation and the like. Hydroprocessing can include hydrocracking and hydro treating. It typically removes components that lower the quality, usability, or energy content of the product, such as metals, oxygen, sulfur and/or nitrogen.

"Liquefaction" refers to conversion of at least a portion of a substantially solid biomass material to produce a liquid fraction or into components that are liquid or are soluble in liquid carriers used in the process. The product of liquefaction is a liquid or suspension or slurry, which may be separated from any residual solids or solid by-products.

"Product oil" refers to a water insoluble mixture of reaction products of thermochemical liquefaction of biomass that, if heated to 100° C., is liquid.

"Product oil obtained from previous thermochemical treatment of similar biomass" refers to whole product oil or any fraction of product oil with or without further processing after recovery from thermochemical treatment at temperature between 250 and 450° C. for residence time between 1 and 120 minutes of lignocellulosic biomass conducted either with or without added product oil or added alcohol reactant. The term "re-circulated product oil" can be used interchangeably and has the same meaning.

"Pyrolysis" refers to thermal depolymerization of biomass at temperatures above 500° C. in an inert atmosphere.

"Refinery" and "refinery stream" refer to a petroleum processing facility and to a liquid stream processed in a petroleum-processing system. The product produced by the liquefaction reaction described herein can be added to a refinery stream, because it is compatible with petroleum refinery streams and processing methods.

"Residence time" refers to the amount of time at which a slurry of biomass, product oil and alcohol reactant is at temperature between 250 and 450° C.

"Short chain alcohol reactant" refers to methanol, ethanol, 1-propanol, 1-butanol, a straight chain primary alcohol or functionalized alcohol with a boiling point lower than 150° C. or a mixture thereof. A mixture may comprise any combination of any of these alcohols in any proportions.

"Thermal liquefaction process" refers to a thermochemical treatment wherein at least a portion of a substantially solid biomass material is converted to a liquid fraction or into components that are liquid or soluble in liquid carriers. The product of liquefaction is a liquid or suspension or slurry, which may be separated from any residual solids or solid by-products.

Any convenient lignocellulosic biomass may be used to practice methods of the invention, including rot wood, switchgrass pellets, reject wood chips, grasses, straws, sawdust, and other feedstocks. The biomass for this process need not be dried for use; typically, the biomass has a moisture content of about 10% to about 70 wt. %. In some embodiments the moisture content in the biomass is reduced to less than 10% by premixing re-circulated product oil with biomass and recovering water by phase separation resulting from lack of water miscibility of the product oil. In some embodiments the biomass is dried to yield a moisture level no higher than 5% before using it as feedstock for the reaction. Wood or wood byproducts can be used, as well as sources such as switchgrass, hay, corn stover, cane, and the like. In some embodiments, the biomass is one or more component derived from whole feedstocks, such as isolated lignin process residual. Wood chips or similar raw wood residues are suitable for use, either alone or in combination with other biomass materials. Such woody materials tend to be high in lignin content. Similarly, grassy materials such as switchgrass, lawn clippings or hay can be used, either alone or in combination with other biomass materials. Grassy materials tend to contain large amounts of cellulose and lower lignin ratios. Partially processed materials, such as solid residues from wood pulp production can also be used. In some embodiments, a mixture of different types of biomass is used; ideally, the biomass will comprise significant amounts (e.g., at least about 10% by weight) of both lignin and cellulose. In some embodiments dried, or partially dried, biogas digestate can be used as biomass feedstock for the novel liquefaction process. Mixtures containing both lignins and cellulose have been found to be most efficiently liquefied by the methods described herein. Thus it may be useful when processing lignin-rich materials, or cellulose-depleted ones like fermentation by-products, to add cellulose-rich materials such as grasses to provide an optimal balance of components in the biomass. In some embodiments, high lignin content feedstocks are beneficial in terms of obtaining reduced oxygen content bio-oil with high degree of aromaticity. Whereas in other applications, high cellulose and hemicellulose content feedstocks are desired in terms of obtaining higher liquefaction yields. Use of residual lignin alone as feedstock typically results in a product oil with lower oxygen content which is desirable from a fuel perspective.

Biomass for use in the methods described herein can be prepared by conventional methods known in the art, such as chipping, grinding, shredding, chopping, and the like. As a general matter, comminution of biomass by mechanical methods to provide smaller particles and/or increased surface area can reduce the processing times, temperatures and pressures required to produce a liquefied product. However, a finely divided biomass is not essential to the operability of the present methods, in contrast with prior art methods for fast pyrolysis which generally require biomass to be relatively dry and small in size, which significantly increases the cost of the process. The biomass is generally made up of discrete pieces. In typical embodiments, the biomass is divided into pieces under about one inch in thickness in smallest dimension, and under about 25 square inches of surface area on their largest surface. In some embodiments, at least 75% of the discrete pieces have a greatest dimension of at least about one inch. In another embodiment, the discrete pieces have a greatest dimension of about 3 inches. The pieces can be of regular shapes, but typically they are irregular in shape. In some embodiments, the average piece has a thickness up to about one centimeter and a largest surface of about 25 square centimeters. In some embodiments, the biomass is divided into pieces small enough so that most of the mass (e.g., at least about 75% of the biomass) can fit through 1-cm diameter sieve holes. Material can optionally be finely divided, where the majority of the material can pass through 7 mm holes or through 5 mm holes when sized or sieved.

Methods of the invention can be conducted in batches or as a continuous flow operation. Parameters of time, temperature and pressure are generally similar for continuous flow or batch processing. In continuous flow mode, the temperature and time parameters correspond to times where the mixture of biomass and the solvent combination are at elevated temperatures, e.g., above about 300° C. In embodiments practiced as a continuous process, some portion of product oil is removed as finished product while most of the product oil process stream is recycled back to continued thermochemical treatment.

In some embodiments, the portion recycled is within the range 50 to 95 wt. % and the portion removed as final product oil is within the range 5 to 50 wt. %. Recycled product oil itself provides adequate solvent to achieve biomass liquefaction. In some embodiments, a make-up solvent can advantageously be added to the process to replace some of the product oil removed from the process stream. In some embodiments, a make-up solvent with high aromatic content is used such as light cycle oil or other sidestream products from petroleum refineries. In some embodiments, ethanol or methanol itself is used as the makeup solvent. In some embodiments, ethanol or methanol is added to the make-up solvent or otherwise introduced to the thermal liquefaction system (thermochemical treatment).

Methods of the invention are typically performed at pressures above 1 atmosphere, where both alcohol reactant vapors, volatile products and product gases give rise to pressure. The thermo-chemical treatment is thus advantageously performed in a pressurized batch container or continuous system at an operating pressure between about 10 bar and about 100 bar when the reaction mixture is heated to reaction temperature. In a preferred embodiment, the mixture in the pressurized container or continuous system is heated to a temperature between about 300° C. and 400° C. or between about 250° C. and 450° C. while the pressure is between about 10 bar and about 70 bar, preferably about 30-60 bar, such as 45-55 bar. Advantageously, the combination of re-circulated product oil and alcohol reactant permits high conversion at operating pressures below about 100 bar, such that the theremochemical treatment can typically be conducted at a pressure within the range 30-60 bar, or 45-60 bar. These pressures are distinctly lower than those required with "ethanol solvolysis." Methods of the invention accordingly provide reduction in cost of capital equipment and safety measures relative to these prior art methods.

The reaction temperature (together with pressure and reaction time) is commonly said to express the "severity" of reaction conditions. The temperature needs to be above a certain level to achieve liquefaction, and not merely dissolve the lignocellulose, or components thereof, e.g. lignin, into alcohol. Organosolv extraction processes, and processes such as those described in WO20197053287 and WO2019/158752 do not go above 250° C. These processes are merely "extracting" lignin/lignocellulose with minor modification of the dissolved biomass. As a complex, cross-linked polymer, lignin has an initial glass transition temperature and a range of temperatures above this over which it gradually becomes fluid. This temperature range is typically around 140° C. to 200° C. To stimulate fragmentation and depolymerization, the temperature needs to be considerably higher than this. When the temperature is increased, the rate of depolymerization will also increase and recalcitrant chemical linkages will break. As the temperature is increased further, to a temperature above 400° C., the rate at which the alcohol reactant thermally decomposes increases at a faster rate. Thus, suitable reaction temperatures for practicing methods of the invention are typically within the range 300 to 400° C. However, in some embodiments, it can be advantageous to include conditioning of the biomass/product oil slurry within the temperature range 250 to 300° C. And in some embodiments, notwithstanding the tendency to promote alcohol decomposition, temperatures within the range 400 to 450° C. can be advantageously used, particularly where residence times are kept short. Thus thermochemical treatment can be practiced in methods of the invention within the range 250 to 450° C. During liquefaction in alcohols, gasses are a direct product of reaction and most predominately seen as a product of reaction at temperatures of 300° C. and higher. At this temperature the liquefaction of biomass is accelerated. Optimum biomass liquefaction temperature is typically around 350° C. One skilled in the art will readily arrive at an appropriate temperature and reaction time through routine experimentation by continuously increasing the temperature in a series of experiments and determining the degree of alcohol loss due to thermal degradation and char formation. In case alcohol consumption is judged to be too high in light of overall process economics, reaction time can be reduced.

In general, comparatively short reaction times (residence times within the thermochemical treatment) are advantageous, within the range 1 to 15 minutes, or 5 to 15 minutes, or between 1 and 120 minutes. Longer residence times lead to decomposition of product oil with associated production of unwanted secondary gaseous products and char. It is accordingly desirable to reduce residence time to less than 2 hours, and preferably less than 1 hour, to reduce formation of char and gas which reduce oil yield. A reaction time of no more than 1 hour is preferred over a reaction time of 2 hours with respect to limiting the degree of recycled product oil decomposition and charring. One skilled in the art will readily determine an appropriate residence time in the thermochemical treatment without undue experimentation, depending on reaction conditions and limitations of process economics. In terms of product oil yield, a very short reaction, such as one less than 1 minute, may not be enough to produce substantial amount of oil. So the optimum residence time is typically longer than one minute, but no so long as to favor decomposition (charring and gas) reactions such as occur in residence times over one hour. In terms of product oil quality, as measured by degree of deoxygenation, stability and acidity, this tends to be improved with increased residence time, up to some point.

However, reduction of residence time reduces both operating expenses (OPEX) and capital expenses (CAPEX) for a production facility. Accordingly, it can be advantageous to apply shorter residence times, notwithstanding somewhat lower yield and product oil quality, depending on overall considerations of process economics. Where the system applied for heating the biomass slurry to reaction temperature works only gradually, residence time can be shorter, where some degree of liquefaction has already been achieved during heat-up. Alternatively, where heat-up time is very rapid, a slightly longer residence time may be appropriate. Optimum residence time can be determined in a continuous setup much more accurately than in a batch setting since the latter imposes a substantial thermal lag while a continuous setup can operate with much greater heating and cooling rates. Accordingly, with a continuous system, a much more accurate determination can be made of the effects of even very short reaction times of around 1 minute.

The total amount of re-circulated product oil used in the slurry can vary depending on reaction conditions. A first aim is to use enough product oil so as to make the biomass slurry pumpable, whereby it can be readily pumped into a pressurized reactor within which the thermochemical treatment is conducted. The amount of product oil required to achieve pumpability can vary depending on the biomass feedstock used and its manner of pre-processing, on the composition of the product oil, on the composition and quantity of any make-up solvent used, and on the quantity and manner in which alcohol reactant is added to the reaction. In some embodiments, only a middle range distillation fraction of product oil is used in recirculation, which will generally permit higher biomass ratios in a pumpable slurry compared with use of whole product oil. In some embodiments, alcohol reactant is added under pressure within a pressurized reactor, however, in other embodiments, alcohol reactant can be added to the biomass/product oil slurry before it is pumped into the pressurized reactor which will further permit high biomass ratios in the slurry. One skilled in the art will readily determine an appropriate ratio of biomass to re-circulated product oil without undue experimentation based on reaction conditions. Typically, the total amount of the recycle bio-oil product used in the slurry will be at least about 50 wt. %, and typically is at least about 100 wt. %, of the mass of the biomass to be treated. In some embodiments, where only a middle range distillation fraction of whole product oil is used for recirculation, a higher ratio of biomass to oil may still provide a pumpable slurry. In some embodiments, a product oil to biomass ratio of at least 2, or at least 3, or at least 4, or at least 5 can be used. Expressed alternatively, the ratio of biomass to re-circulated product oil w/w in some embodiments is at most 1:2, or 1:3, or 1:4, or 1:5, with optimal range 1:1 to 1:5. In some embodiments the biomass and recycled product oil is premixed and preheated to up to 200° C. to facilitate a more homogeneous mixture which further promotes pumpability.

In some embodiments re-circulated product oil comprises a fraction of whole product oil as distinguished by boiling range. Preferably a fraction having a boiling point below 350° C. is used, but a fraction having boing point between 100° C. and 300° C. may be used, or a between 200° C. and 400° C., or between 300° C. and 600° C. The fraction of recycled oil can be generally described according to its boiling range as the lower fraction, or upper fraction, or middle fraction. In some embodiments the recycled oil products is not cooled or is only partially cooled prior to recirculation. This will reduce the cost for heating and thus OPEX.

Re-circulated product oil ideally contains oxygen and has high aromaticity for maximum positive impact on biomass liquefaction. Recirculating product oil on its own provides adequate solvent to achieve biomass liquefaction. However, the degree of biomass liquefaction and the net oil yield is improved when an alcohol, e.g. ethanol, is added to the recycled oil. It is desirable to add both ethanol and recycle oil to the reaction due to a synergistic effect in which liquefaction is improved over using either recycled product oil or ethanol alone. Re-circulated product oil, or biomass tars, may decompose when subjected to thermal processing; however, addition of an alcohol reactant suppresses charring and improves the liquefaction yield. This effect is likely explained by the inhibitory and suppressing effects of primary alcohols with regards to polymerization. The synergistic effect of using both recycled oil and an alcohol reactant in biomass liquefaction is observed independent on the ratio of biomass to re-circulated oil.

Changing the biomass to vessel loading has limited to no effect on product yields but the ratio of biomass to alcohol reactant (e.g. ethanol) is of importance. The effect is most notable for ratios of biomass to ethanol of 1:1 w/w or greater (when the amount of biomass exceeds the amount of alcohol reactant). The ratio of biomass feedstock to alcohol reactant inside the reactor at reaction conditions is more important for the reaction chemistry than the ratio of feedstock to alcohol reactant fed into the reactor. By increasing the amount of alcohol reactant relative to biomass feedstock fed into the reactor in a continuous setting while keeping this relative ratio lower inside the reactor effectively ensures a higher degree of replenishment of spent and reacted alcohol reactant. When the ratio of alcohol to biomass inside the reactor is changed it directly affects the reaction kinetics as one skilled in the art will readily appreciate. In batch mode operation the concentration of reactants, both biomass/lignin and ethanol, drops over time and it is expected that continuous operation will thus improve oil yield and reduce char yield since reactant concentrations are effectively kept at a constant maximum due to constant replenishment. One skilled in the art can readily determine the rate of replenishment needed for each of biomass feedstock and alcohol reactant based on routine optimization of results from a continuous setup and thus be able to determine the optimum ratio of biomass to alcohol to be fed into the system.

In some embodiments the recycled product oil and biomass is premixed and pumped prior to mixing with alcohol reactant. This is particularly advantageous in the case of recycling oil at 200° C. which otherwise would cause low boiling alcohol reactant to evaporate and exert a vapor pressure greater than 1 atm necessitating that the pre-mixing vessel is pressurized which it otherwise need not be. Biomass is generally stable at temperatures up to 100° C. and sometimes up to 200° C. after which decomposition will occur if heated higher without the presence of e.g. an alcohol reactant.

The total amount of alcohol reactant to be added to the slurry of biomass and product oil can vary depending on reaction conditions. One consideration is simply process economics: In some cases, incorporation of alcohol reactant into product oil is revenue positive, favoring use of larger amounts of alcohol. The alcohol reactant is consumed in the liquefaction reaction but in order to ensure appropriate reaction kinetics, unspent alcohol typically remains at the end of the process. In some embodiments, more than 50% of the alcohol reactant initially added is recovered as unspent alcohol reactant. In some embodiments unspent alcohol reactant is recovered by distillation and recycled to be used in the liquefaction. The amount of alcohol reactant added can be about the same (by weight) as the amount of biomass for a given batch process, or it can be lower or higher. Moreover, much lower amounts of alcohol reactant can be used in the present methods, and in some embodiments the amount of the alcohol is about half or less than half of the amount of biomass used (by weight). In some embodiments, the amount of alcohol is up to about half of the weight of the biomass to be treated, e.g., about 0 wt. % to about 50%, or up to about 25%. Or expressed alternatively the ratio of biomass to added alcohol w/w is advantageously within the range 0.1:1 to 2:1, or up to 4:1, or between about 20:1 and 4:1, or between 10:1 and 4:1, where then optimal range is typically from 1:9 to 5:1. In some embodiments, it is about 5% to about 25% of the weight of biomass to be treated, or between 10% and 25%. A dry weight (total weight less water content) may be used in this ratio for consistency, even though moist biomass may be used in the process. The ability to operate with low volumes of alcohol reactant is an important advantage of the present methods compared with "ethanol solvolysis." Expressed as weight percentage of the biomass/product oil slurry, alcohol content is typically added in an amount corresponding to between 2% and 150% of the initial slurry dry weight before alcohol addition. The optimal range is between 6% to 45% of the slurry dry weight.

Since added alcohol reactant is consumed in the liquefaction process, it is necessary to add enough alcohol to the biomass/product oil slurry to replenish lost alcohol and thereby maintain an optimum alcohol density within the reactor at steady state in embodiments that apply a continuous process. In some embodiments, in the case where the alcohol reactant is ethanol, an appropriate added alcohol density within a thermal reactor at steady state is 17 kg/m3 or 5, or 9, or between 2 and 52. In some embodiments, a thermal liquefaction process is optimized by selecting an appropriate ratio of biomass to ethanol for any given set of process conditions that is sufficient to maintain an ethanol density within the thermal reactor portion of the system at steady state of 17 kg/m3 or 5, or 9, or between 2 and 52. One skilled in the art can readily determine an appropriate ratio with routine optimization. Typically the ratio of biomass to added ethanol is within the range of 1:9 and 5:1 w/w but can be within the range of 5:1 to 15:1 in some embodiments. In the case of alcohol reactants other than ethanol, the appropriate density is approximately the same as with ethanol, although the effective "molarity" may be higher, for example, as in the case where the alcohol reactant is methanol.

Ideally an alcohol reactant such as ethanol is replenished as it is consumed in the process. This can be readily achieved when conducting the process continuously rather than in batch mode. The reaction chemistry is dependent on the alcohol concentration inside the reactor. Alcohol reactant density of 0.017 g/ml is typically sufficient but with routine experimentation one skilled in the art will optimize the process, typically by increasing the alcohol reactant density up to at least 0.05 g/ml after which increasing the density further may only have a reduced effect on liquefaction performance. One skilled in the art will readily appreciate the need to ensure that reactant ethanol density is sufficient for adequate liquefaction performance. An alcohol density of around 0.05 g/ml is preferable but positive effects by either lowering or increasing density from this point may be manifested depending on tolerance for ethanol loss and increased reaction pressure which can increase OPEX and CAPEX respectively in a commercial setting.

A shift in reaction kinetics will typically be observed when increasing the reactant alcohol density after a certain point. This shift can occur for ethanol between a density of 0 to 0.1 g/ml. This shift will indicate that the concentration of ethanol is approaching or has reached a point of saturation after which increasing density further has only limited positive effect. It may nevertheless be desirable to increase the density beyond this point if the process economics support alcohol consumption. When increasing ethanol density both gas and oil yield increases; however, after a certain density the positive effect of increasing density further shows only minor additional enhancement.

The optimum alcohol density is a function of reaction time. In a continuous setting an alcohol reactant will be continuously replenished to varying degrees depending on the residence time in the reactor in order to always ensure a minimum alcohol density.

The partial pressure exerted by the reactant alcohol does not need to be supercritical at reaction conditions. It is advantageous to operate at subcritical conditions from a cost of operation perspective. Effective liquefaction can be obtained at partial pressure of the alcohol reactant substantially lower than the supercritical pressure. In the case of using ethanol as a reactant, which has a supercritical pressure of 61 bar, a partial pressure of ethanol of 32 bar is sufficient for obtaining effective conversion of biomass feedstock. In some embodiments, the thermochemical treatment is conducted under circumstances where total pressure, including alcohol partial pressure, is less than 60 bar, or less than 55 bar, or less then 50 bar, or less than 45 bar. In some embodiments, partial pressure of added alcohol reactant is subcritical and <60 bar, or <50 bar, or <45 bar, or <35 bar.

The partial pressure of the alcohol reactant is determined differently depending on whether the process is carried out in a batch or continuous mode. In a batch reactor, a sealed vessel of fixed volume V, the predetermined amount of added alcohol of weight m will at any reaction temperature above the supercritical temperature (e.g. ethanol has supercritical temperature of 241 C) yield a reactive single phase atmosphere with a fixed density rho=m/V. This single phase atmosphere exerts different pressures dependent on the temperature. Only empirical models exist that can predict this pressure, the partial pressure of the alcohol. One example is presented in Bazaev, A. et al., "PVT measurements for pure ethanol in the near-critical and supercritical regions," International Journal of Thermophysics (2007) 28(1):194. This shows empirical data of pressure exerted (alcohol partial pressure) for various isotherms (reaction temperatures above the supercritical temperature) in the case of ethanol at different densities (rho).

In a continuous setting the pressure of the reaction vessel is fixed by presetting a backpressure regulator that will ensure that the pressure inside the reactor vessel never exceeds this pressure independent on how much flows in and out of the system. The amount of alcohol added to the reactor vessel will only dictate the partial pressure of alcohol if the pressure setting of the back pressure regulator (the total system pressure) is high enough, but generally, the backpressure regulator setting will dictate the maximum alcohol partial pressure achievable inside the system. The partial pressure of alcohol is thus determined as equals to or less than the total reaction pressure inside the reaction vessel. Gaseous species and other volatiles (gas phase at reaction temperature) are formed during reaction effectively exerting a partial pressure and together with alcohol reactant the sum of the partial pressure of the volatiles and the alcohol equals to the total system pressure (as determined by the backpressure regulator setting). The partial pressure of alcohol can be increased by increasing the relative rate at which alcohol is added to the reaction vessel to counter the effects of either alcohol decomposition/loss over time or the effects of lowered alcohol partial pressure due to the presence of other volatiles in the system. Since alcohol is consumed over time, a shortening of the reaction time will also result in an increased alcohol partial pressure. The total system pressure (as determined by the backpressure regulator) is the most important setting for regulating the alcohol partial pressure, since a partial pressure of alcohol can never exceed this pressure.

The partial pressure of alcohol in a continuous setting is determined as to achieve sufficient alcohol density which is needed for reaction. A fixed target density at a predetermined reaction temperature, e.g. 350° C., can thus be used to identify and determine the desired partial pressure through empirical data as described in the method for determining batch reactor partial pressures above. In a continuous setting the back pressure will thus need to be adjusted to relieve pressure at this pressure or at a higher pressure to achieve the desired partial pressure of alcohol during reaction conditions.

In some embodiments, liquefaction is conducted in the absence of an effective amount of added catalyst: the product oil/alcohol reactant combination and operating temperature and pressure provide efficient liquefaction, converting at least about 40% of the biomass solids (on a dry weight basis) into liquid products and at least 60% into liquid and/or gaseous products and at least 90% into liquid and/or gaseous and/or solid products. As a result of the solvent and condition selections described herein, high efficiency can be obtained without adding a catalyst, and use of conventional catalysts to promote the liquefaction process result in only slightly improved efficiency.

In some embodiments the solid residual product of liquefaction can be used as a soil amendment. In doing so, the solid residual can be called biochar and yields an effective means of sequestering carbon. In some embodiments the solid residual product can be burned for process heat.

The produced product bio-oil is shelf stable with no sedimentation or water formation during shelf storage for 12 months.

In some embodiments, methods of the invention further comprise recovering product oil and subjecting it to further processing. In some embodiments, product oil may be recovered in a manner that does not separate unspent alcohol reactant, i.e., unspent alcohol reactant may be included within the product oil. Unspent alcohol content of product oil can be 0.1 and 15 wt. % in total. This is particularly relevant where methanol is used as alcohol reactant. In some embodiments, all unspent alcohol is included within product oil. The recovered product oil can be subjected to Hydrodeoxygenation with hydrogen over a heterogeneous catalyst with no charring, or a degree of charring of less than 10 wt % relative to the oil. Exhaustive deoxygenation can be obtained, i.e. complete deoxygenation to yield a product with 0% oxygen, by hydrodeoxygenation over a catalyst even at temperatures as low as 300° C. Both oil product from isolated lignin residual and from whole lignocellulose can be treated by hydrodeoxygenation with similar results.

Lignin-oil hydrodeoxygenation yields predominantly functionalized cyclohexanes whereas hydrodeoxygenation of oil from lignocellulose yields both functionalized cyclohexane species as well as cyclopentane species due to the content of carbohydrates and C5 sugars in lignocellulose whereas the lignin rich feedstock used for making the lignin-oil is relatively richer in aromatics stemming from lignin. The cyclohexane products of hydrodeoxygenation of both lignin and lignocellulose can be the following, but not limited to, cyclohexane, methyl-cyclohexane, 1,4-dimethyl-cyclohexane, 1,2-dimethyl-cyclohexane, 1,4-dimethyl-cyclohexane, ethyl-cyclohexane, 1,2,4-trimethyl-cyclohexane, (1.alpha.,2.beta.,3.alpha.)-1,2,3-trimethyl-cyclohexane, 1-ethyl-4-methyl-cyclohexane, propyl-cyclohexane, (1-methylpropyl)-cyclohexane, butyl-cyclohexane. The cyclopentane products of hydrodeoxygenation of lignocellulose can be the following, but not limited to, methyl-cyclopentane, ethyl-cyclopentane, 1-ethyl-3-methyl-cyclopentane.

Beneficially, the bio-crude oil produced by methods of the invention can conveniently be further processed along with petroleum based refinery streams, or when mixed with such petroleum-based refinery streams, using known methods including hydroprocessing and/or catalytic cracking. The liquefaction results in a product stream that is miscible with typical petroleum-based refinery streams and is compatible to be blended with and co-processed with such refinery streams. This reduces both capital and transportation costs relative to prior methods, making it a particularly environmentally friendly way to utilize biomass for generating liquid fuels or organic feedstocks. Through further processing of bio-crude oil obtained using methods of the invention, a drop-in transportation fuel blendstock or other value-added processed liquid product is provided.

Figure 23:
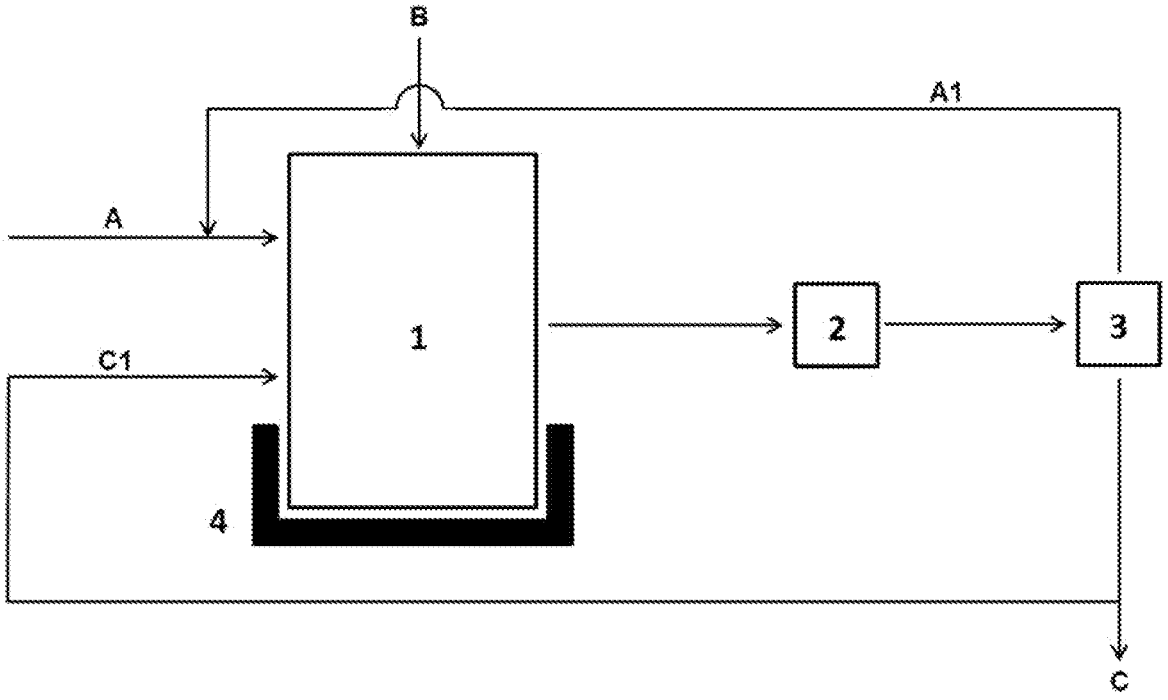
FIG. 23 One embodiment of a system suitable for practicing methods of the invention.

One example of a suitable system for performing methods of the invention is depicted in simplified form in FIG. 23. Shown is a diagram of a system with a reaction container (1) having inlets to permit introduction of biomass (B), recycled product bio-oil (C1), and alcohol (A). The system will typically also have pressure and temperature sensors for monitoring the reaction conditions, and may also include mixing apparatus suitable for blending the biomass-containing composition is used to process. It is understood as explained herein that the 'reaction container' can be a vessel or pot, or it can be a pipe or similar flow-through system; where the container is a pipe, feature (1) would represent the portion of the pipe within a heated zone, where the liquefaction reaction occurs. An outlet is provided in reaction container (1) also, so crude product from the reaction container following liquefaction can be removed. In the diagram, crude product is conducted from the reaction container to a separation subsystem (2) such as a filtration subsystem or that separates the liquefied products from remaining solids. The first separation subsystem can be a filtration apparatus, a settling system, or a flash drum, for example, to separate the liquid product from insoluble materials. The crude liquid material is then conducted to an optional thermal or chemical separation subsystem (3), such as a distillation apparatus. This subsystem can be used to process the filtered material, if desired, to produce a recycle stream of product bio-oil (C1) used as solvent for the liquefaction process and providing recovery of unspent alcohol (A1). It would then remove only a portion of the liquid bio-oil product (C), and any of the liquid bio-oil product not used for a recycle stream is typically collected as the bio-oil product (C). Methods for design and construction of the refinery system are well known to those in the art and can readily be accomplished based on the disclosures herein and conventional engineering principles. Solids removed from the crude product stream (e.g., residues captured by filtration of the crude product), and/or gases collected from the reaction container, can optionally be used to heat the reaction container via a heating element (4). Alternatively, heating can be provided by conventional electrical resistance heating elements or by direct heating from a combustion process, or by indirect heating using heated air or superheated steam, for example.

The novel methods of the invention use solvent liquefaction process to convert biomass solids into liquid form for transportation and/or further processing. The methods involve heating biomass in a pressurized reactor with recirculated product oil and an alcohol reactant to solubilize much of the biomass material, providing a liquefied product and optionally residual solids. The liquid reactant medium comprising recycled product oil and alcohol provides efficient liquefaction under the temperature and pressure conditions described herein. They also do not interfere with subsequent processing and utilization of the bio-oil product, and thus do not have to be separated from the bio-oil product. Residual solids can be mechanically removed, either by decantation of the liquid, or by e.g. filtration methods, to provide a crude liquid product, or by flash drum separation of the volatiles from insoluble materials, which are generally non-volatile. The process results in sufficient depolymerization and chemical modification of the biomass to produce a liquefied product that can conveniently be handled by liquid processing methods and equipment.

The novel solvent liquefaction process produces biocrude in very high yields with improved product qualities compared to the current generation of fast pyrolysis reactors, without using expensive catalysts or excessive hydrogen inputs. The process does not require biomass particle size to be as small or moisture content as low as for the gasification or pyrolysis processes. The novel process also produces a high biocrude yield with substantially reduced oxygen content, leading to attractive economics. Recycling of already heated product oil can also reduce the need for downstream cooling and therefore reduce energy cost of the process and make the final heating of the reactant slurry to the desired set point temperature less energy consuming.

The novel process achieves oxygen rejection (reduction) by forming water and/or carbon dioxide, carbon monoxide, and some water-soluble organics. These are readily separated from the biocrude product so that the biocrude product can be further processed. This oxygen rejection reduces the amount of hydrogen require during hydroprocessing of the bio-oil from the new methods and increases the combustible energy content for transportation fuel applications.

The present invention provides a method and a system for processing crude plant-derived biomass to produce a liquid bio-oil product that can be used as transportation fuel for the maritime sector with no or limited post-processing or be further treated to produce a liquid fuel or feedstock, for example a general transportation fuel, or be further treated to produce high value chemicals and solvents. The method and system can optionally include additional processing steps such as hydro processing to produce a transportation fuel or similar liquid product or selective catalytic reduction or oxidation to provide high value single chemicals or a mixture hereof. Methods and systems for converting oxygenated 'green crude' products such as this bio-oil product of the current invention into further processed products are well known in the art. See e.g., U.S. Pat. Nos. 4,759,841 and 7,425,657.

The bio-oil produced by the methods described herein can be added to a conventional petroleum refinery stream for co-processing into a finished fuel product. Further processing of the bio-oil produced by the methods described herein can include hydroprocessing, and/or hydrodeoxygenation, and/or catalytic cracking. Further processing readily converts the bio-oil produced by the instant processes into a useful transportation fuel.

The bio-oil produced by the methods described herein can be used as is as a drop in fuel to be consumed in two stroke engines such as those found on large ocean going vessels or stationary engines or engines otherwise capable of running on heavy fuel. The bio-oil can advantageously be fractionated to provide a fraction more suitable for this application. The bio-oil can be blended with existing marine fuels, fossil or non-fossil derived, to yield a blend satisfying the requirements for combustible properties in a marine engine, stationary engine or a diesel engine.

As will be readily understood by one skilled in the art, any of the features of any of the embodiments described can be combined.

Examples

Experimental Procedure in Cylindrical Pipe Reactors

Experiments were conducted in a close sealed non-stirred batch reactor with an internal volume of 11 ml. The reaction vessel was a thick walled stainless steel pipe that was closed off in both ends. One end had an opening that was closed and sealed shut with a bolt during experiments. This opening allowed for addition of the vessel contents prior to experiments and careful pressure relief after experiments. Reactions were conducted by adding up to 3 g of both dried and non-dried biomass feedstock, up to 2.25 ml of alcohol solvent (99.9% ethanol) and up to 2 g of co-solvent prior to sealing the vessel. An inert N2 atmosphere was ensured inside the vessel prior to sealing by flushing the empty volume with N2 manually for a few seconds. The reaction vessel was inserted into an oven in order to heatup the contents of the vessel to up to 350° C. Up to four vessels could be heated at the same time. Reaction times were either 1 hour or 2 hours. The wall temperature of the reaction vessels were measured for some of the experiments and showed a heating time to the set point of 350° C. of around 45-60 min. The reaction times were defined as the duration of the heating of the vessels. This effectively means that the reaction time for which the vessels experienced the setpoint temperature was around 0-15 min and 60-75 min for the 1 and 2 hour experiments respectively. The pressure during reaction was autogeneous. For some experiments the pressure was measured using a pressure gauge connected to the reaction vessel and located outside of the oven. This connection was made through a thin pipe so that the increased reactor vessel volume would be negligible with an increase of no more than 5%. After each experiment the vessels were cooled by an air fan until room temperature. The vessels were weighed after cooling checking against the weight of the vessel prior to the experiment as a means of verifying non-leakage. The room temperature vessels were after reaction opened carefully by unscrewing the bolt mentioned in the above and left for 1 hour with the bolt only very loosely connected/screwed on so as to ensure complete evacuation of formed gasses. After one hour of evacuation of gasses the weight of the reaction vessel was noted and the mass loss thus becomes a measure of the mass of gas formed during reaction. The reaction vessels were then opened carefully by removing both endcaps of the pipe comprising the reaction vessel and the vessel contents were extracted using acetone. After conducting five runs in the oven it was discovered that complete submersion of the pipes in an acetone bath subjected to 1 hour sonication provided improved mas balance closure and 5-10 wt % improvement in oil yields so for all experiments following this discovery this became the standard method for extracting vessel contents prior to downstream separation and analyses. Data obtained from prior to using sonication in an acetone bath has been adjusted accordingly so as to still be comparable. Upon acetone extraction some of the experiments resulted in more charring and pipe wall fouling than others that would require mechanical scraping to ensure complete extraction. The acetone was subsequently filtered on glass fiber filter (pore size 0.6 micron) in order to separate the liquid fraction for the solid fraction. The weight of solids were determined by drying for three days at 50° C.

The liquid fraction was then evaporated (to remove light species, solvent, water, and acetone) at 60 mbar and 45 C, after which the residual heavy fraction was weighed for determination of oil yield. Yields of product oil, solid/char and gas were obtained as recovered masses and evaluated as weight percent relative to the mass of biomass feedstock on dry basis, e.g. per mass of dry wood added prior to reaction.

Experimental Procedure in Stirred Vessel

Experiments were conducted similarly to what is described in the procedure for pipe reactor experiments but instead of using non stirred cylinder reaction vessels a 500 ml stirred Parr batch autoclave was used and gas yield was read as pressure formed (barg after cooling). Cooling was by submersion in an ice bath. Reaction temperature was 350° C. and reaction time was 45 min (the time needed to ensure setpoint temperature was reached). 50 ml to 120 ml of ethanol was added prior to reaction and 40 g to 120 g of either lignin (enzymatic hydrolysis lignin from wheat straw), pine or birch wood. Obtained oil was analyzed with respect to its elemental compositions (CHNS—O) where oxygen was determined by difference.

1. Reaction and Ethanol Partial Pressure.

Experiments were conducted following the procedure for pipe reactor experiments using up to 3 g grinded pine wood pellets with 0.75 ml ethanol and up to 2.25 ml ethanol without addition of biomass feedstock. Pressure was measured and logged. Temperature was measured and logged with a thermocouple mounted to the external wall of the pipe reactor. The oven was preheated to 350° C. prior to insertion of the pipe reactor. The duration of the experiments was 2 hours.

FIG. 1 shows the reaction pressure as a function of reaction time for varying feedstock and ethanol loadings at 350° C. (circles: 0.75 ml ethanol only; triangles: 1.5 ml ethanol only; diamonds: 2.25 ml ethanol only; squares: 1 g biomass and 0.75 ml ethanol; crosses: 3 g biomass and 0.75 ml ethanol; connected dots: temperature on secondary axis). For the blank runs (no feedstock only alcohol added) the ethanol partial pressure reaches a maximum of 32 barg with 2.25 ml ethanol added and for the lowest amount of ethanol added (0.75 ml) the partial pressure reaches a maximum of only 18 barg. This is substantially lower than the supercritical pressure of ethanol of 61 bar which means that the alcohol reactant is not supercritical at any of the reaction conditions and merely a heated ethanol vapor phase. When pine wood is added to the pipe reactor together with ethanol there is a clear pressure increase indicating that gaseous species are formed during the reaction. The pressure increases rapidly after about 2000 seconds of reaction corresponding to a vessel temperature of about 300° C. at which the conversion of biomass is thus accelerated.

It is desirable to reduce reaction time in order to maximize oil yield. This corresponds to ending the reaction after 1 hr after which the reaction pressure is about 90 barg when the feedstock loading is high at 3 g. Letting the reaction run for up to 2 hours causes the pressure to increase to above 100 barg indicating disadvantageous increased gaseous decomposition of formed oil thus reducing oil yield.

The varying quantities of ethanol reactant added corresponds to a density of the subcritical ethanol phase at reaction conditions as determined by the ratio between amount of ethanol added and fixed reaction vessel volume. This relationship is depicted in Table 1. For all of the different ethanol vessel loadings the partial pressure exerted by ethanol is below the supercritical pressure. The partial pressure of the reactant alcohol shown in the table represents the maximum partial pressure since ethanol is consumed in the reaction effectively yielding a drop in partial pressure, and hence also a drop in density, over time. The total pressure in these experiments does however increase over time due to the formation of volatiles, e.g. gaseous decomposition products. Ideally ethanol reactant needs to be replenished as it is consumed such as it would be in a continuous setting. The results indicate that a density of the ethanol reactant of 0.052 g/ml at reaction conditions is sufficient for reaction.

TABLE

Density of the ethanol phase at reaction conditions for experiments in pipe reactors. Liquid ethanol density is 0.789 g/ml at ambient conditions. The exact internal volume of pipe reactor is 11.31 ml.

| Ethanol loading (ml & g) | 0.25 ml (0.20 g) | 0.5 ml (0.39 g) | 0.75 ml (0.59 g) | 1.5 ml (1.18 g) | 2.25 ml (1.77 g) |
|---|---|---|---|---|---|
| Density (g/ml) | 17 | 35 | 52 | 0.10 | 0.16 |
| Ethanol partial pressure at 350° C. (bar) | 12* | 15* | 18 | 21 | 32 |

*denotes pressures obtained by linear extrapolation.

2. Ethanol as Reactant in Thermal Liquefaction.

Experiments we conducted as described in the procedure for pipe reactor experiments using 1 g of grinded pine wood pellets and pure alcohol reactant (99.9%) in varying quantities. The reaction time was 2 hours and the temperature was 350° C. Varying number of replicates was performed at each point for a total of 14 experiments. Yields were determined as described in the procedure.

Figure 2:
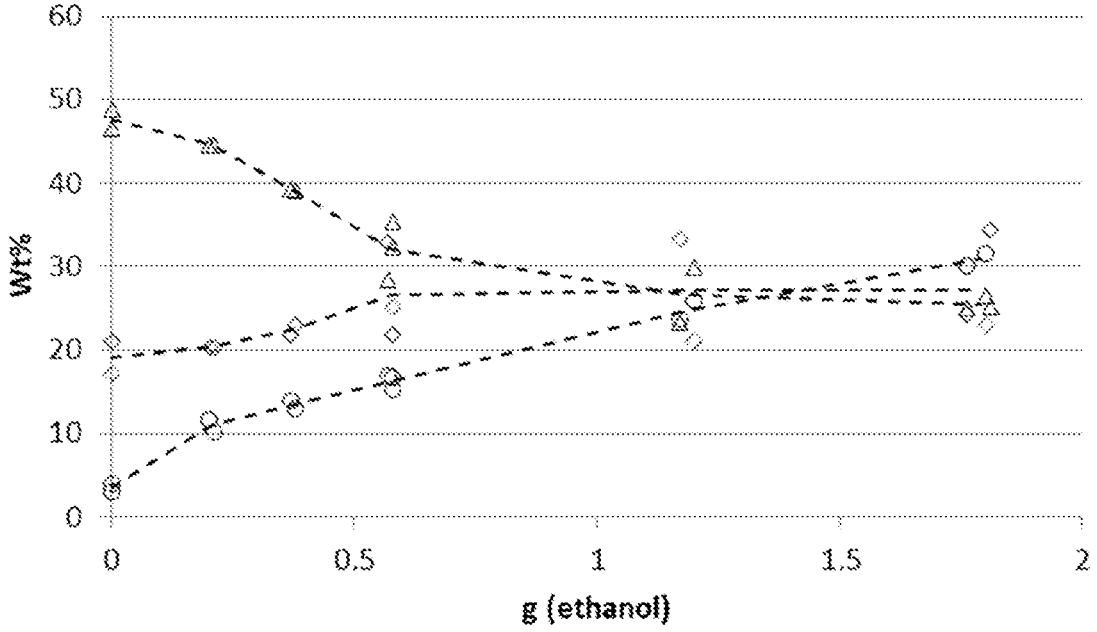
FIG. 2 Effect of amount of ethanol added on product yields.

FIG. 2 shows, as a function of ethanol added, oil yield (circles), solid yield (triangles) and gas yield (diamonds). As shown under these conditions the oil yield is proportional to ethanol added strongly indicating that the reaction chemistry is dependent on the ethanol concentration indicating the role of ethanol as a reactant rather than as a solvent. When adding 0.6 g of ethanol, (density at reaction conditions of 0.052 g/ml) or more, the gas yield seems to have reached a plateau and the decrease in char yield decreases but at a reduced rate. At 0 g ethanol added the residual heavy product obtained after evaporation was clearly not definable as any type of oil product but clearly resembling micro particles of char. Experiments using no alcohol also yielded a distinctly different smell upon opening of the reaction vessels and only dry char was visible indicative of a clear difference between adding just small amounts of ethanol and no ethanol at all.

Figure 3:
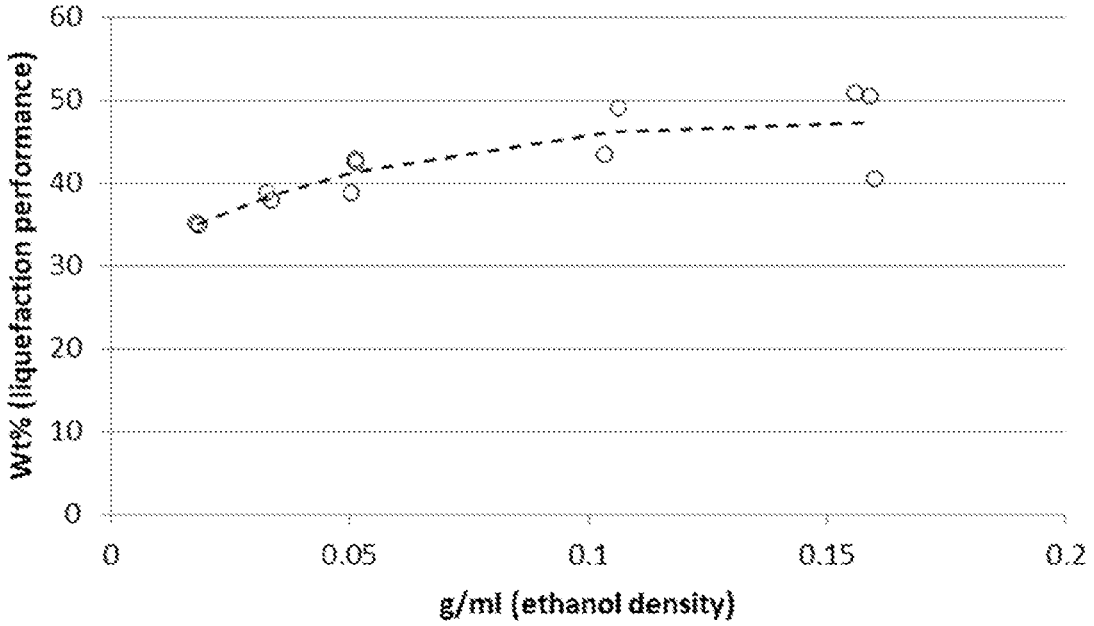
FIG. 3 Effect of ethanol density on liquefaction performance.

Adding the lowest quantity of ethanol reactant, 0.2 g, which corresponds to a density at reaction conditions of 0.017 g/ml is sufficient to yield liquefaction but one skilled in the art would optimize to increase the ethanol density preferably up to at least 0.052 g/ml after which increasing the density further may only have a reduced effect on liquefaction performance. This is not entirely clear from FIG. 2 alone but when determining oil yield by difference, or rather, determine the liquefaction performance as a conversion yield following the following equation the results can be seen in FIG. 3.

Liquefaction Performance, e.g. Oil Yield Per Difference:

100%−(solids yield wt %)−(gas yield wt %)

The liquefaction performance clearly shows an improved effect of increasing ethanol reactant density up to 0.05 g/ml after which the improvement in effect diminishes and plateaus. One skilled in the art would ensure that reactant ethanol density is sufficient for adequate liquefaction performance meaning that an ethanol density of around 0.05 g/ml is preferable but positive effects by either lowering or increasing density from this point may be manifested depending on tolerance for ethanol loss and increased reaction pressure which can increase OPEX and CAPEX respectively in a commercial setting.

3. Effect of Ethanol on Product Yields.

Experiments were conducted as described in procedure for experiments in stirred batch autoclave with lignin as feedstock. The experiments are similar to what was done in Example 2, except that a larger stirred vessel was used and gas yield could thus not be quantified by weighing the vessel and the reaction time was very short since the vessel was immediately cooled upon reaching the set point temperature contrary to a 2 hour reaction time in Example 2.

Figure 4:
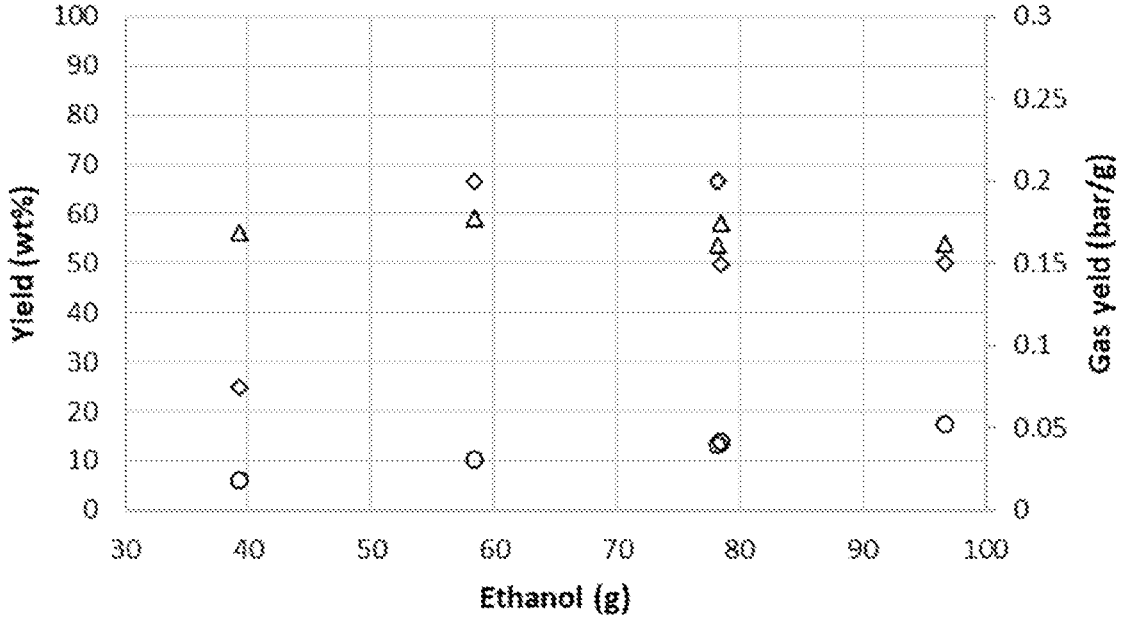
FIG. 4 Effect of amount of ethanol added on product yields.

FIG. 4 shows the effect on yields (circles: oil; triangles: solid; diamonds: gas) as a function of adding different quantities of ethanol (50 ml to 125 ml) with fixed lignin addition (40 g). Oil yield seems to follow a linear proportional relationship as demonstrated in Example 2 and FIG. 2 also. The lack of proper mixing/stirring at the conditions of very low alcohol addition (amount of alcohol<amount of lignin) is likely the reason for the relatively low recovered oil yields in Example 2 as char formation/condensation on the reactor wall will be more likely to occur.

The ethanol reactant loading in the 500 ml stirred vessel corresponds to varying densities at reaction conditions shown in Table 2. It can be seen that when the alcohol reactant density exceeds 0.12 g/ml both gas and char yield decreases. The gas yield more than doubles when the ethanol density is increased from 0.08 to 0.1 g/ml indicating that a density around that range contributes to a change in reaction kinetics. This observation was equally seen in Example 2 when increasing the ethanol density beyond 0.05 g/ml; however, in this case the reaction time was substantially longer at 2 hours. These results reinforce the conclusions of Example 2 but indicate that an optimum density determined by one skilled in the art is also a function of reaction time among other factors. This further strengthens conclusion that in a continuous setting an alcohol reactant needs to be continuously replenished to varying degrees depending on the residence time in the reactor in order to always ensure a minimum alcohol density.

TABLE 2

Density of the ethanol phase at reaction conditions for experiments in stirred 500 ml batch autoclave. Liquid ethanol density is 0.789 g/ml at ambient conditions. The exact internal volume of stirred autoclave is 500 ml.

| Ethanol mass loading (g) | 39.5 | 59.2 | 78.9 | 98.6 |
|---|---|---|---|---|
| Ethanol volume loading (ml) | 50 | 75 | 100 | 125 |
| Density (g/ml) | 79 | 0.12 | 0.16 | 0.20 |

4. Effect of Ethanol on Elemental Composition of Bio-Crude.

Experiments were conducted as described in Example 3 and the molar 0/C and H/C of the product oil was determined.

Figure 5:
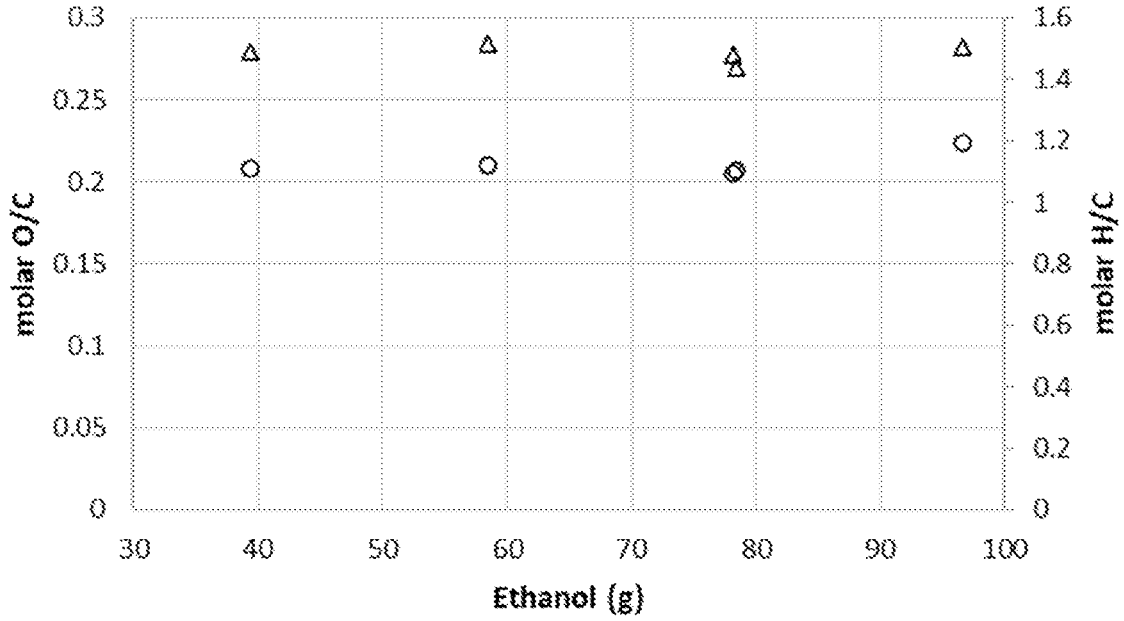
FIG. 5 Effect of amount of ethanol added on the elemental composition of oil.

FIG. 5 shows the effect on elemental oil composition (circles: molar 0/C; triangles: molar H/C) as a function of adding the different quantities of ethanol (50 ml to 125 ml) with fixed lignin addition (40 g). O/C and H/C are seemingly unchanged indicating that adding more lignin than ethanol to the reaction vessel has no negative implications on oil quality. The results clearly demonstrate that for the reaction conditions herein a change in ethanol reactant density from 0.079 to 0.20 g/ml has no effect on product oil composition and therefore no apparent effect on oil quality. Combined with the observations of Example 2 and 3 this indicates that alcohol reactant density is important in terms of optimizing for product oil yield and less so for product oil quality.

5. Effect of Recycle Oil in Ethanol Liquefaction.

Figure 6:
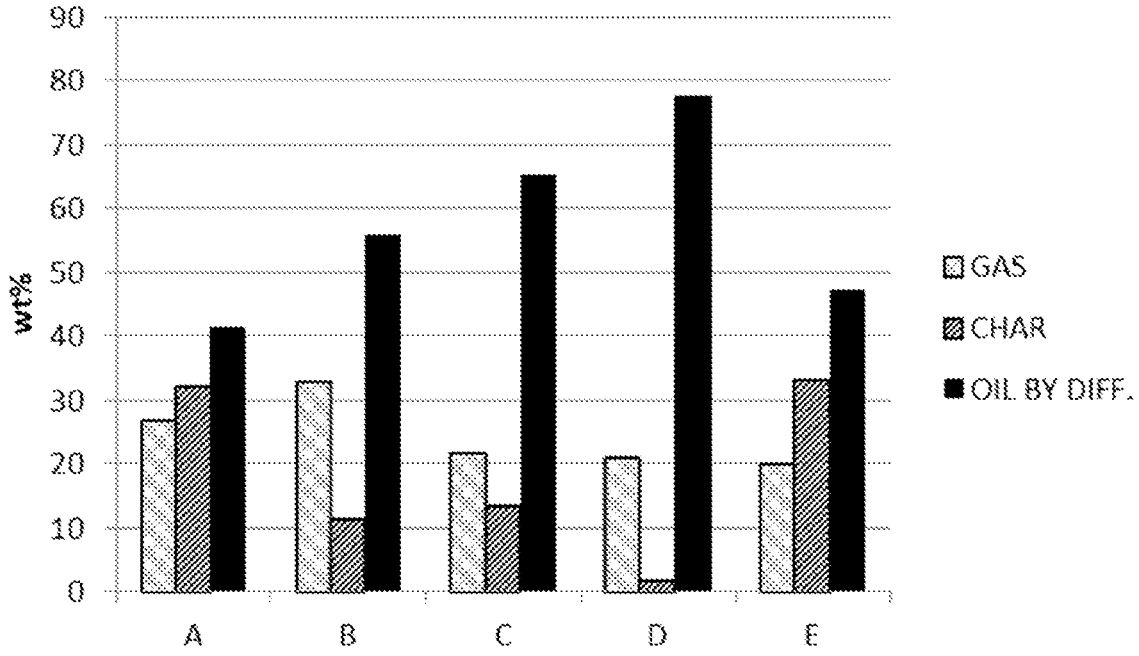
FIG. 6 Effect of different model compounds added as "recycle oil" in the presence of ethanol.

Experiments were conducted following the procedure for pipe reactor experiments using 1 g ground pine wood pellets and 0.75 ml ethanol to which was added different model compounds to simulate the process conditions of recycling oil FIG. 6 shows bio-crude oil, gas and char yields for a series of experiments with 2 hour reaction time with different recycle oil model compounds (A: no recycle model compound; B: 1.85 g biomass gasification tar product, "aromatic"; C: 1.96 g anisole, "aromatic"; D: 2.05 g m-cresol, "aromatic"; E: 2.05 g hexadecane, "non-aromatic/aliphatic"). Oil yields were determined as the remainder from mass added after subtraction of char and gas yield. This determination of oil yield cannot distinguish produced oil from recycle oil model compound. It is clearly seen that adding the recycled oil model compounds anisole, m-cresol and gasification tar yields a net improvement in oil yield, where char is plainly reduced relative to the reaction with biomass and ethanol alone. The model compounds used for recycling also shows that hexadecane has no effect on decreasing the degree of charring and therefore has no effect on improving oil yield. This is likely due to its aliphatic composition. It seems to be advantageous for the recycled oil model compound to contain oxygen and have high aromaticity.

6. Synergistic Effect of Ethanol with Aromatic Recycle Oil in Thermal Liquefaction.

Experiments were conducted as described in Example 5 where the model compound was anisole.

Figure 7:
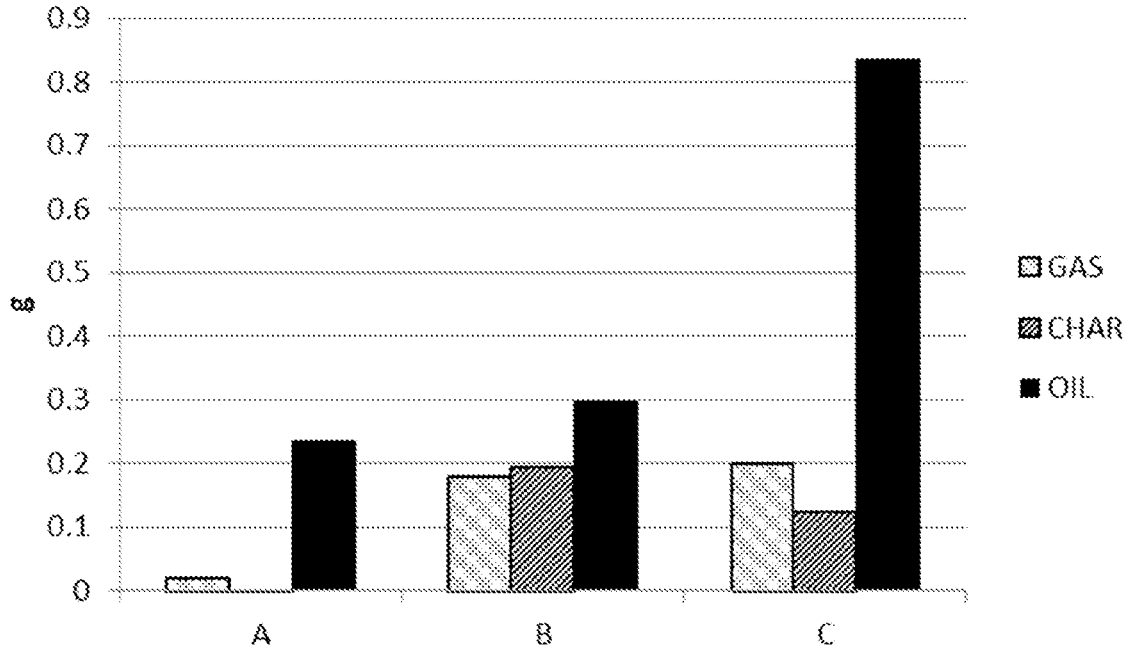
FIG. 7 Effect of various combinations with Anisole.

FIG. 7 shows a comparison of yields for three different experiments with the addition of 2 g anisole to the reaction vessel as a "model" of recycled product oil (A: Anisole and ethanol only; B: Anisole and biomass only; C: Anisole, biomass and ethanol). The oil yield observed after experiment A is likely unreacted anisole that if given longer time in the rotary evaporator, as described in the experimental procedure for pipe reactor experiments, would evaporate. For all experiments the oil yield illustrated is likely too high due to this effect and char yield is thus better used to evaluate liquefaction performance. For experiment B, adding only anisole and biomass to the reaction, the char yield is reduced and thus liquefaction improved over just liquefying biomass in ethanol only as shown as experiment A in FIG. 6. This confirms that recycled oil on its own provides adequate solvent to achieve biomass liquefaction. However, the degree of liquefaction and the net oil yield are plainly improved where ethanol is added to recycled oil (anisole) and biomass, as shown in experiment C. This indicates that it is desirable to conduct thermal liquefaction with recycle oil solvent and added ethanol reactant.

7. Synergistic Effect of Ethanol with Wood Tar Recycle Oil in Thermal Liquefaction.

Experiments were conducted as in Example 6, except that the model compound was a tar product from biomass gasification.

Figure 8:
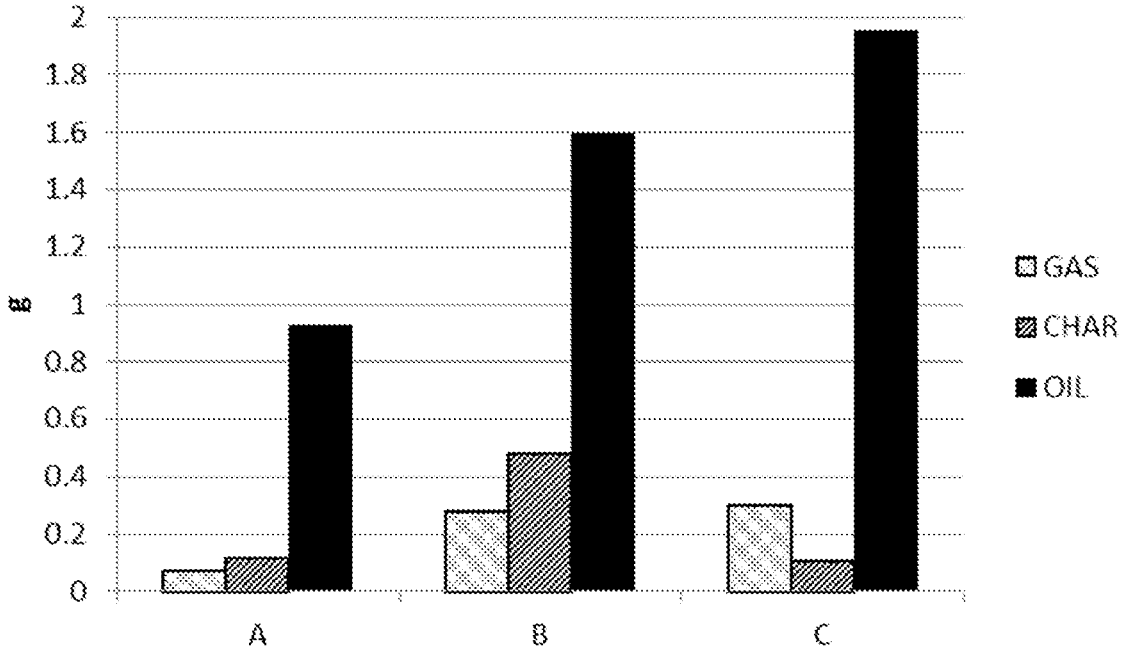
FIG. 8 Effect of various combinations with Tar.

FIG. 8 shows a comparison of yields for three different experiments with the addition of wood gasification tar to the reaction vessel as a "model" of recycled product oil (A: 1.27 g tar and ethanol only; B: 2.07 g tar and biomass only; C: 1.85 g tar, biomass and ethanol). The tar product was added in different quantities due to the difficulty in pipetting similar quantities. The observations are identical to the ones described for FIG. 7 in Example 6; however, the wood tar added does contribute to increased charring that makes it impossible to distinguish actual char yield from the added biomass. The addition of ethanol does however suppress charring of the tar and an improvement in terms of liquefaction is observed for experiment C where both tar and ethanol is added to the reaction with biomass.

8. Synergistic Effect of Ethanol with Actual Recycled Product Oil.

Experiments were conducted as in Example 7 with varying reaction conditions both with and without addition of either ethanol and biomass.

Figure 9:
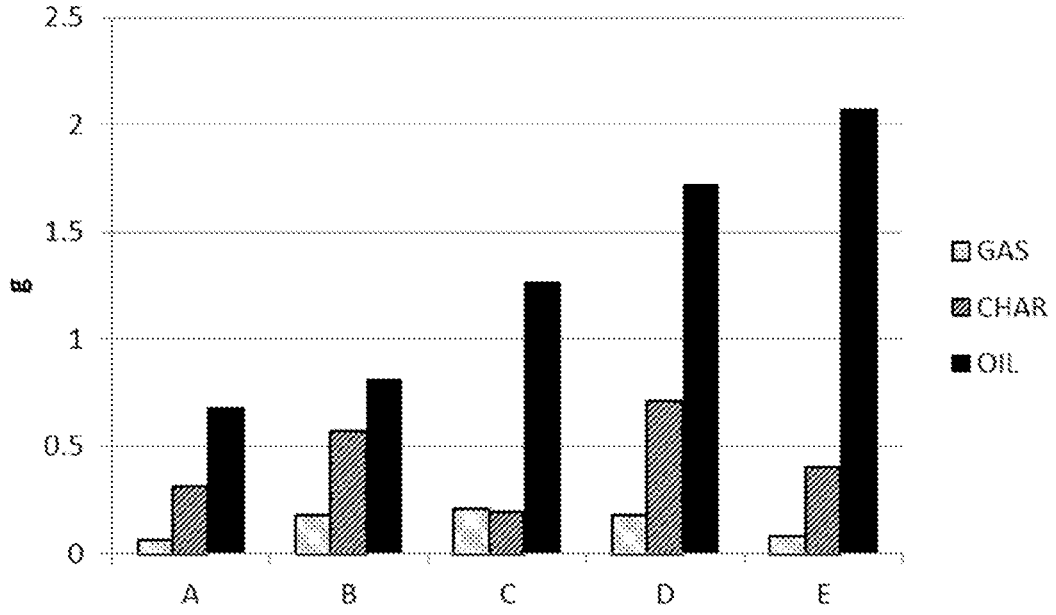
FIG. 9 Effect of various combinations of real recycled oil with and without ethanol.

FIG. 9 shows a comparison of yields for different experiments where recycled oil was added to the reaction vessel either by itself, with biomass or with both biomass and ethanol (A: 1.02 g recycle oil only; B: 1.00 g recycle oil and biomass only; C: 1.01 g recycle oil, biomass and ethanol; D: 2.03 g recycle oil and biomass only; E: 2.02 g recycle oil, biomass and ethanol). The reaction time was 1 hour for all experiments. Recycled oil was produced after repetition of experiments where 3 g pine wood was reacted in 0.75 ml ethanol for 1 hours. Experiment E experienced a leakage with a mass loss of 0.19 g of ethanol vapors and/or gases during reaction but the results are included still for reference. Experiment A shows that the recycled oil alone will decompose when reheated to 350° C. It is however likely that reheating to a lower temperature will cause it to remain intact but it is not thermally stable at a temperature equal to or greater than the temperature at which the oil was produced. Experiment B shows that treating biomass in recycle oil alone results in liquefaction of the biomass but with an overall negative oil yield due to decomposition of the recycle oil. When adding both recycle oil and ethanol (experiment C) the generated yields of oil (amount of oil formed as defined by the difference between final amount and amount of oil added) is positive with 0.26 g (28 wt % yield relative to added biomass) and this number is substantially higher than in the case of non-recycling (16.3 wt % yield relative to added biomass), Experiment A in FIG. 6.

The observations described for a comparison of experiment B and C are equally valid for a comparison of yields from experiment D and E; however, the leakage during the experiment has likely reduced oil yield. As shown, a synergistic effect of ethanol and recycled product oil is apparent at both the lower and higher ratios of recycled oil to biomass tested.

9. Determining Advantageous Ratio of Biomass to Alcohol.

Experiments were conducted in pipe reactors using 1-3 g of grinded pine wood pellets and 0.75 ml (0.6 g) pure alcohol (99.9%). The reaction time was 2 hours and the temperature was 350° C. Varying number of replicates were performed at each point for a total of 15 experiments. Yields were determined as described in the procedure for experiments in pipe reactors.

Figure 10:
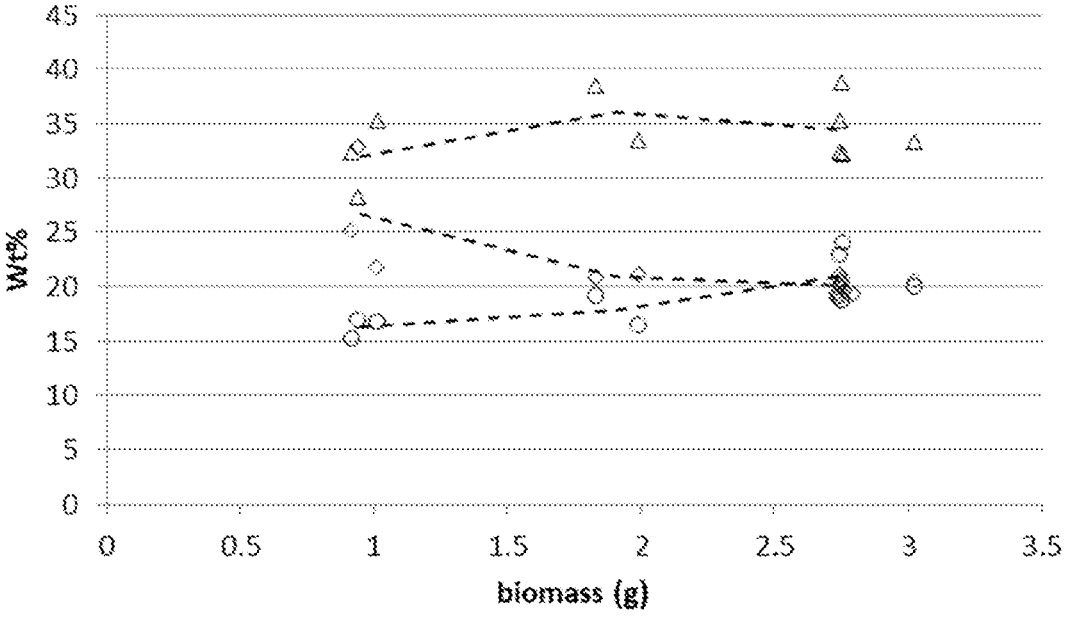
FIG. 10 Effect of amount of biomass added on product yields.

FIG. 10 shows, as a function of feedstock loading (grams of pine wood), oil yield (circles), solid yield (triangles) and gas yield (diamonds). As shown under these conditions solid yield remains constant but gas yield drops and oil yield increases as the feedstock loading is increased. Surprisingly a high oil yield of above 20 wt % is achieved at the highest solid to ethanol loading of 5:1 (3 g pine wood). Limitations with the experimental setup sets a limit for how much biomass can be added to the reaction vessel due the low density of wood. It is likely that even higher solid loading, obtainable by compressing the feedstock, would result in an improved oil yield.

Figure 11:
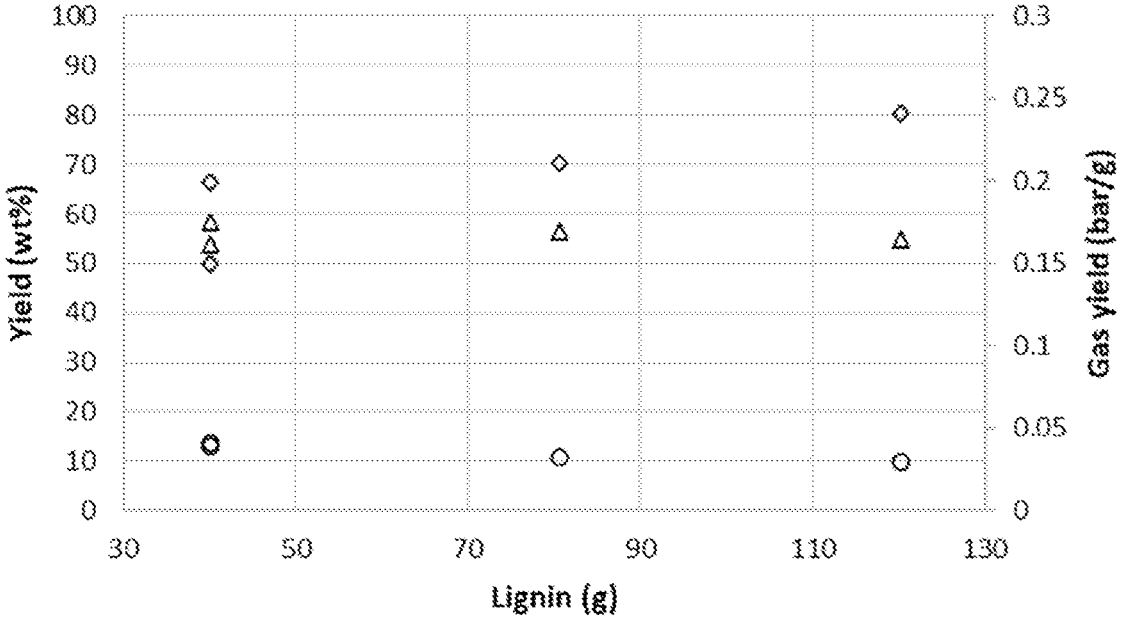
FIG. 11 Effect of degree of lignin loading on product yields.

Experiments were also conducted in a stirred vessel with lignin as feedstock and FIG. 11 shows the effect on yields (circles: oil; triangles: solid; diamonds: gas) as a function of adding different quantities of lignin (40 g to 120 g) with fixed 100 ml alcohol addition. Oil and char yields are seemingly unchanged. This indicates that increasing the loading of feedstock has none to limited negative effect on oil yield.

From this one can conclude that changing the biomass or lignin to vessel loading has limited to none effect on product yields but the ratio of biomass or lignin to alcohol reactant (e.g. ethanol) is of importance. The effect is most notable of ratios of biomass or lignin to ethanol of 1:1 (wt:wt) or greater. If the data is used to elaborate on the effects on yield during continuous operation the ratio of biomass feedstock to alcohol reactant inside the reactor at reaction conditions is more important for the reaction chemistry than the ratio of feedstock to reactant fed into the reactor. By increasing the amount of alcohol reactant relative to biomass feedstock fed into the reactor in a continuous setting while keeping this relative ratio lower inside the reactor effectively ensures a higher degree of replenishment of spent and reacted alcohol reactant. When the ratio of alcohol to biomass inside the reactor is changed it directly affects the reaction kinetics as one skilled in the art would attribute this to an effective change of reactant concentrations (both biomass feedstock and alcohol are reactants). Since these experiments only depict the results of batch mode operation where the concentration of reactants, both biomass/lignin and ethanol, drops over the course of the experiments it is expected that continuous operation will thus improve oil yield and reduce char yield since reactant concentrations are effectively kept at a constant maximum due to constant replenishment.

10. Determining Advantageous Residence Time.

Figure 12:
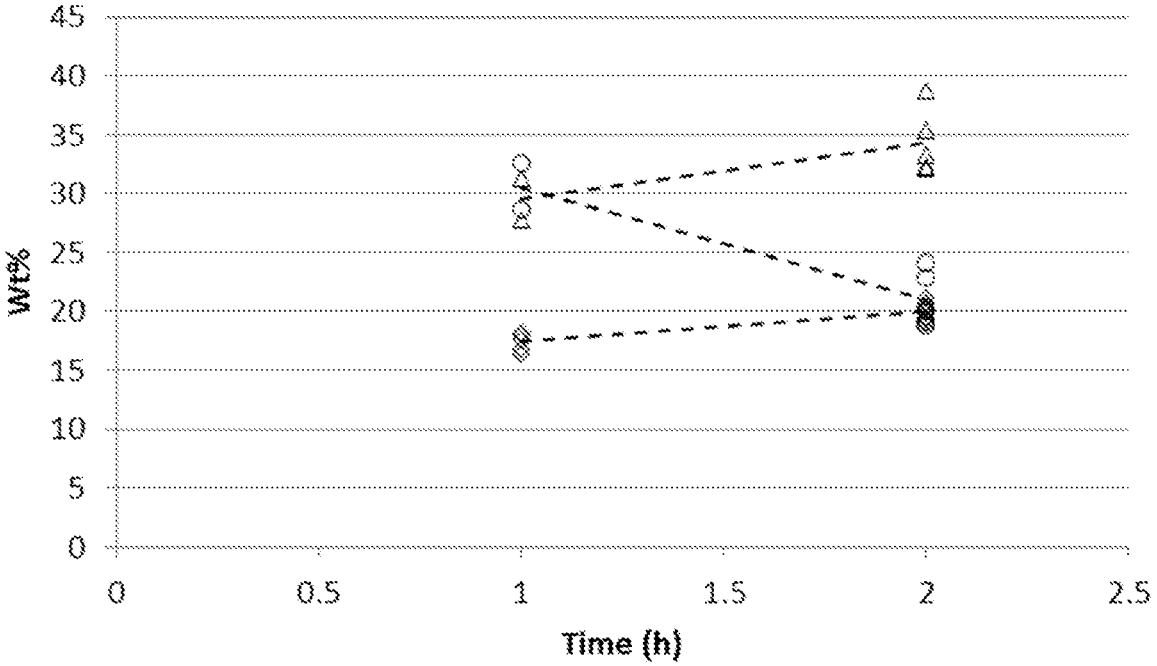
FIG. 12 Effect of residence time on product yields when using 1 g pine wood.
Figure 13:
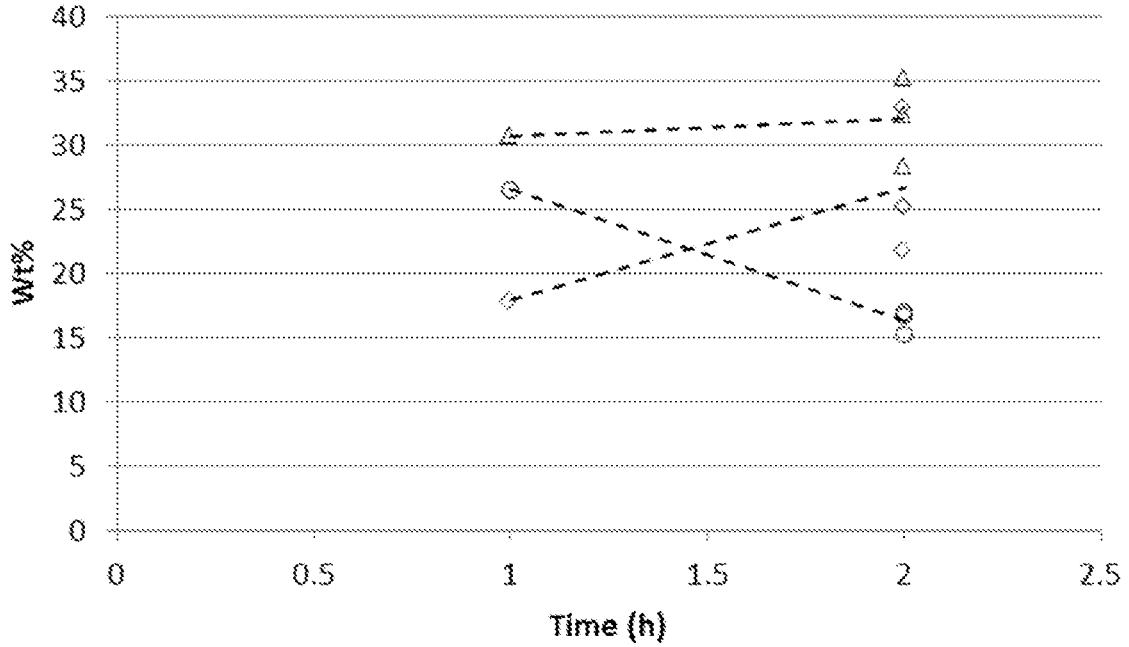
FIG. 13 Effect of residence time on product yields when using 3 g pine wood.

Experiments were conducted in pipe reactors using up 1-3 g of grinded pine wood pellets and 0.75 ml (0.6 g) pure alcohol (99.9%). Reaction time was 1-2 hours and the temperature was 350° C. Varying number of replicates was performed at each point for a total of 19 experiments. Yields were determined as described in the procedure for experiments in pipe reactors. FIG. 12 shows, as a function of reaction time for experiments using 1 g of grinded pine wood pellets, oil yield (circles), solid yield (triangles) and gas yield (diamonds). FIG. 13 shows, as a function of reaction time for experiments using 3 g of grinded pine wood pellets, oil yield (circles), solid yield (triangles) and gas yield (diamonds).

Figure 14:
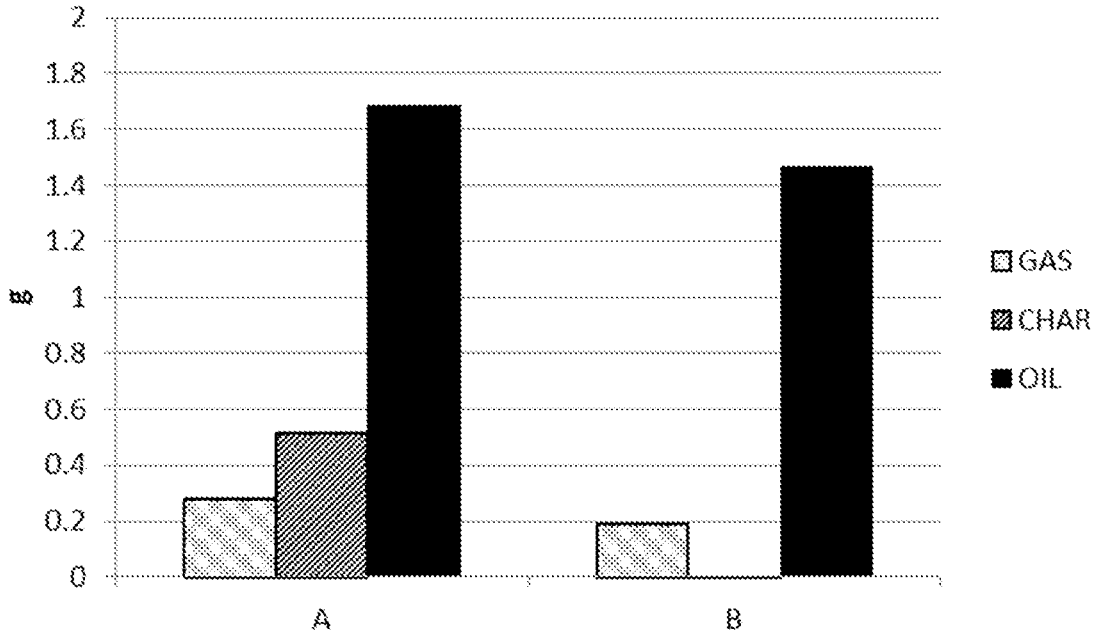
FIG. 14 Effect of reaction time, 2 h (A) vs. 1 h (B), for two experiments with recycled oil, ethanol and biomass.

Experiments were also conducted in pipe reactors as in Example 5 but instead of adding a model compound real recycled and previously recovered wood oil was added. The recycled oil was obtained after multiple repetitions of the same experiment at 350° C. with 0.75 ml alcohol and 1-3 g of pine wood added to the reaction vessel. The results of these experiments are shown in FIG. 14 as a comparison of yields for two different experiments where recycled oil was added to the reaction vessel together with biomass and ethanol but treated at different reaction times (A: 2 h reaction with 2.02 g recycle oil; B: 1 h reaction with 1.07 g recycle oil).

On both FIG. 12 and FIG. 13 it can be clearly seen that reduced reaction time yields in an improved oil yield and reduced charring and gaseous yield. A short reaction time is therefore desirable. Increasing the reaction time to more than one hour results in charring and/or decomposition to gasses of formed oil.

Looking at FIG. 14 recycled oil was produced after repetition of experiments where 3 g pine wood was reacted in 0.75 ml ethanol for 2 hours. Experiment A shows increased charring and an oil yield lower than the amount of recycle oil added indicating charring and decomposition of the recycle oil. This is likely due to long reaction time as a shorter reaction time of 1 h, experiment B, yields near zero charring (0.01 g) and an oil yield of 0.4 g (44 wt %) when the initially added recycle oil is subtracted. This oil yield is likely even higher in reality due to difficulties in extracting all produced oil from the reaction vessels after reaction as both gas and char yield is substantially lower in the case of recycling oil than in the case on not adding recycled oil as shown in experiment A in FIG. 6. The actual oil yield in the case of non-recycling of oil at similar reaction conditions was only 16.3 wt % (2.3 stdev). The oil yield is thus more than doubled and nearly tripled by adding recycled oil. The amount of recycle oil is different (A=ca. 2 g, B=ca. 1 g), which makes a direct comparison between experiment A and B more difficult. But it is noteworthy that Experiment B does show a very high oil yield with no charring.

One skilled in the art can conclude that is desirable to reduce reaction time to less than 2 hours, and preferably less than 1 hours to reduce the formation of char and gas stemming directly from the biomass conversion and thus impact oil yield negatively. Furthermore, A reaction time of no more than 1 hour is preferable over a reaction time of 2 hours with respect to limiting the degree of recycled product oil decomposition and charring. The optimum reaction time can be determined by one skilled in the art on a continuous setup much more accurately than in a batch setting since the latter imposes a substantial thermal lag and a continuous setup will be able to be operated with much greater heating and cooling rates and thereby much more accurate representation of the effects of even very short reaction times of around 1 minute.

11. Application to Diverse Feedstocks.

Figure 15:
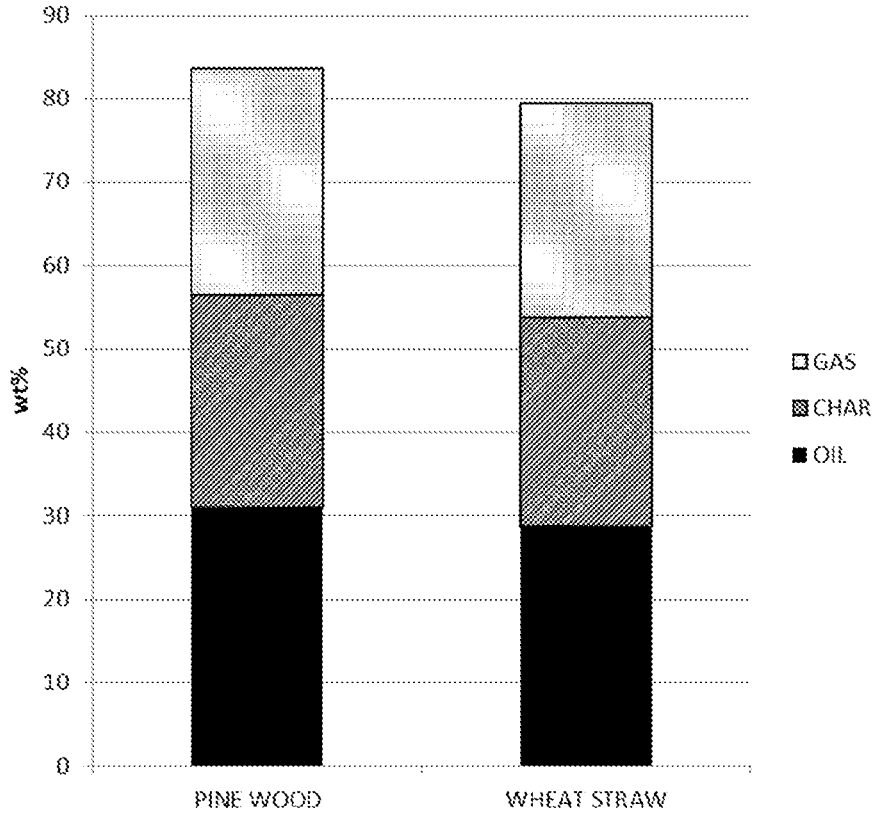
FIG. 15 Effect different feedstocks (pine wood and wheat straw) on product yields.
Figure 16:
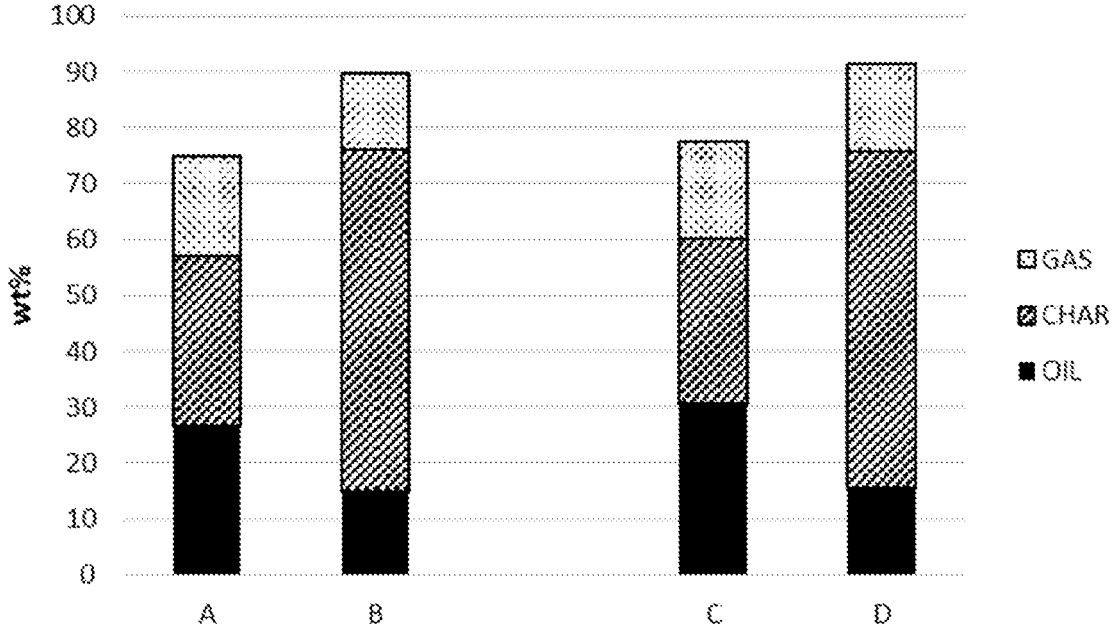
FIG. 16 Effect of different feedstocks (pine wood and lignin) on product yields.

Experiments were conducted in both pipe reactors and a stirred vessel using different biomass feedstock at varying operating conditions. The reaction temperature was 350° C. and ethanol was added for all experiments. FIG. 15 and FIG. 16 show the yields of experiments in pipe reactors whereas FIG. 17 and FIG. 18 show the elemental composition of the oil product and product yields respectively for experiments carried out in a stirred vessel.

FIG. 15 shows a comparison of yields from two experiments where the only difference is the type of feedstock, grinded wheat straw pellets vs. grinded pine wood pellets. Reaction conditions were 350° C., 2 hours, 1 g biomass feedstock, and 2.25 ml ethanol. Wheat straw and pine wood yields similar yields and in particular the oil yield is similar indicating that the process conditions are not only suitable for conversion of woody biomass but also grasses.

FIG. 16 shows a comparison of yields from experiments where the type of feedstock is either grinded pine wood pellets or dried enzymatically pretreated hydrolysis lignin (wheat straw, 5 wt % moisture). Reaction conditions were 350° C., 1 hours, 0.75 ml ethanol, and 1 g and 3 g of biomass feedstock (A: 1 g pine wood; B: 1 g lignin; C: 3 g pine wood; D: 3 g lignin). Pine wood clearly yields a higher oil yield and reduced charring over the use of the dried lignin rich solid residual as feedstock.

Figure 17:
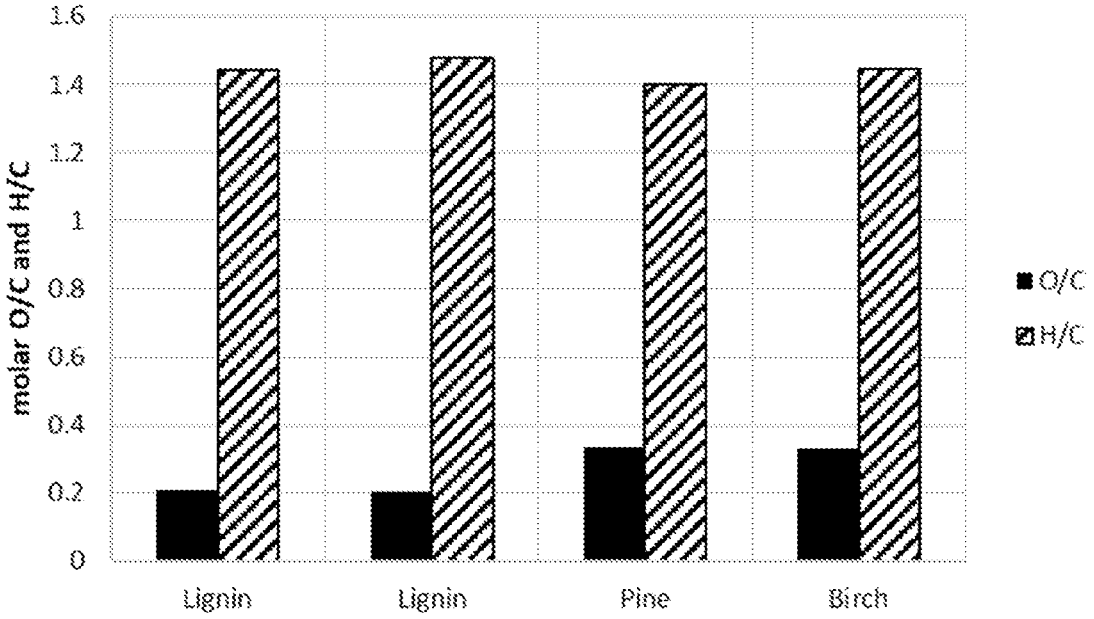
FIG. 17 Effect of feedstock biomass (lignin vs. pine vs. birch) on elemental composition of oil.
Figure 18:
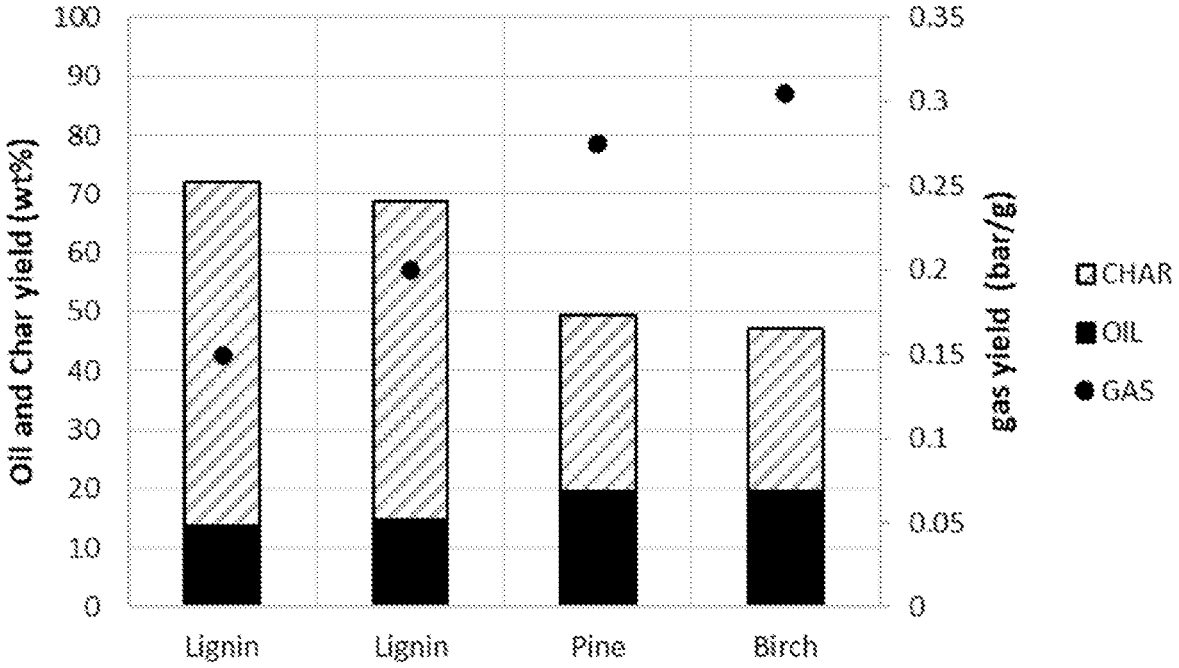
FIG. 18 Effect of feedstock biomass (lignin vs. pine vs. birch) on product yields.

FIG. 17 shows the effect on elemental oil composition (O/C and H/C) as a function of adding 40 g of different feedstocks (lignin, pine wood and birch wood) to 100 ml of ethanol. O/C and H/C are nearly identical for the two different types of wood and yields a slightly higher oxygen content (and O/C) than the resulting oil form lignin feedstock as one would expect with higher oxygen content in the woody feedstock to begin with.

FIG. 18 shows the effect on yields (oil, char and gas) as a function of adding 40 g of different feedstocks (lignin, pine wood and birch wood) to 100 ml of ethanol. Yields are similar for the two types of wood. Oil yield is higher and char yield lower when using woody feedstock instead of using lignin. This indicates that whole biomass is a suitable feedstock for the process and not just pure lignin.

It can be concluded that whole biomass or lignocellulose yields improved oil yield over using lignin alone but the product composition and therefore quality is similar. Use of lignin only as feedstock does however result in a product oil which generally has lower oxygen content which is desirable from a use of fuel perspective.

12. Hydrodeoxygenation of Ethanol-Liquefaction Bio-Crude Over Heterogeneous Catalysts.

Larger batches of oil were obtained from experiments in stirred vessels obtained by repeating the same experiment several times. Two batches of oil, one with wood-oil and another with lignin-oil, was obtained after cooking 80 g of lignin in 100 ml ethanol and repeating the experiment five times and after cooking 50 g of beech wood in 100 ml of ethanol and repeating the experiment six times.

A smaller stirred 300 ml Parr autoclave was used for conducting hydrodeoxygenation (HDO) of the produced oil samples, guaiacol for reference and decane solvent as a blank. A total of eight experiments were conducted. 1-3 g of commercially available NiMo catalyst was added to the autoclaves together with 0.16 ml of DMDS per gram of catalyst. The DMDS was added to ensure the catalyst remained sufficiently sulfided during hydrodeoxygenation. This method had previously been identified as working very well in order to achieve maximum efficiency of the catalyst. 3-5 g of wood-/lignin-oil was hereafter added to autoclave together with up to 90 ml heptane (to ensure sufficient volume of the stirred reaction medium) followed by closing and flushing with hydrogen until pre-pressurizing with hydrogen to 50 bar. The experiment would proceed with heating the autoclave to up to 340° C. for HDO experiments on lignin-oil and 300° C., 320° C. and 340° C. for HDO of wood-oil. A single experiment with 39 g of lignin-oil and 5 g catalyst was also conducted but the oil volume was deemed insufficient alone to be affected by the stirrer, so after subjection to a combined total of 16 hours of heat exposure at 340° C. about 50 ml of Decane was added to reaction vessel and the HDO was extended with another 12 hours (combined heat exposure was thus 28 hours). The reaction temperature for experiments with up to 5 g of oil added was held at 4 hours until rapid cooling in an ice bath. The final pressure at room temperature was logged for all experiments. All HDO experiments on lignin/wood-oils resulted in a pressure <50 bar efter reaction indicating hydrogen consumption. Blank experiment with decane only indicated no hydrogen consumption. The contents of the autoclave were subsequently subjected to filtration and phase separation as water formation was identified for all experiments expect the blank. The filtercake was washed with acetone and weighed after drying at 30° C. for three days. The decane-soluble/water-insoluble fraction was subjected to GC-MS analysis. For all experiments this fraction had a light orange color and a diesel like smell. For all experiments the filtercake comprised visually solely of spent catalyst with no clear signs of char formation. No sign of residual unconverted oils were observed for any of the experiments. Char yield as determined on the basis of added oil was 6.6 wt % for lignin-oil HDO at 340° C., 6.4 wt % for wood-oil HDO at 300° C., 5.3 wt % for wood-oil HDO at 320° C., and 5.0 wt % for wood-oil HDO at 340° C. For the single experiment with 39 g of lignin oil subjected to HDO at 340° C. the char yield was 2.1 wt %.

Table 3 shows a table with species identified corresponding to the residence time for all GC-MS chromatograms. The species identified are automatically chosen as the most closely resembling compound according to a similarity index of above 90 for a database on MS spectra. Table 3 needs to be used as reference when looking at chromatograms for all of the experiments.

TABLE 3

Reference table for GC-MS chromatograms showing identified compounds for different column times

| Minutes | Compound |
|---|---|
| 2.403 | water |
| 2.487 | Butane |
| 2.587 | Butane, 2-methyl- |
| 2.633 | Pentane |
| 2.823 | Pentane, 2-methyl- |
| 2.883 | Pentane, 3-methyl- |
| 2.943 | Hexane |
| 3.137 | Cyclopentane, methyl- |
| 3.323 | Hexane, 2-methyl- |
| 3.38 | Cyclohexane |
| 3.493 | Pentane, 3-ethyl- |
| 3.59 | Heptane |
| 3.943 | Cyclohexane, methyl- |
| 4.05 | Cyclopentane, ethyl- |
| 4.307 | Heptane, 4-methyl- |
| 4.37 | Heptane, 2-methyl- |
| 4.707 | Cyclohexane, 1,4-dimethyl- |
| 4.84 | Cyclopentane, 1-ethyl-3-methyl- |
| 4.93 | Octane |
| 5.087 | Cyclohexane, 1,2-dimethyl-, trans- |
| 5.217 | Cyclohexane, 1,4-dimethyl- |
| 5.783 | Cyclooctane, 1,4-dimethyl-, cis- |
| 5.873 | Cyclohexane, ethyl- |
| 6.36 | Cyclohexane, 1,2,4-trimethyl- |
| 6.493 | Octane, 4-methyl- |
| 6.607 | Ethylbenzene |
| 6.723 | Heptane, 4-(1-methylethyl)- |
| 7.117 | Cyclohexane, 1,2,3-trimethyl-, (1.alpha., 2.beta., 3.alpha.)- |
| 7.347 | Cyclooctane, methyl- |
| 7.497 | 1-Ethyl-4-methylcyclohexane |
| 7.593 | Cyclohexane, 1-ethyl-4-methyl-, trans- |
| 7.717 | Nonane |
| 8.28 | 1-Ethyl-4-methylcyclohexane |
| 9.31 | Cyclohexane, propyl- |
| 10.427 | Undecane, 5,6-dimethyl- |
| 11.333 | Nonane, 3-methyl- |
| 13.823 | Octane, 2,3,3-trimethyl- |
| 14.733 | Heptane, 2,5,5-trimethyl- |
| 15.117 | Cyclohexane, (1-methylpropyl)- |
| 15.54 | Cyclohexane, butyl- |
| 20.277 | Undecane |
| 26.207 | Dodecane |
| 30.513 | Pentadecane |
| 34.047 | Tetradecane |
| 37.117 | Pentadecane |
| 39.88 | Hexadecane |
| 41.16 | Pentadecane, 2,6,10-trimethyl- |
| 42.433 | Heptadecane |
| 42.59 | Pentadecane, 2,6,10,14-tetramethyl- |
| 44.827 | Heptadecane |
| 45.08 | Hexadacane, 2,6,10,14-tetramethyl- |
| 47.09 | Heptadecane |
| 49.237 | Eicosane |
| 51.363 | Eicosane |
| 53.763 | Eicosane |

Figure 19:
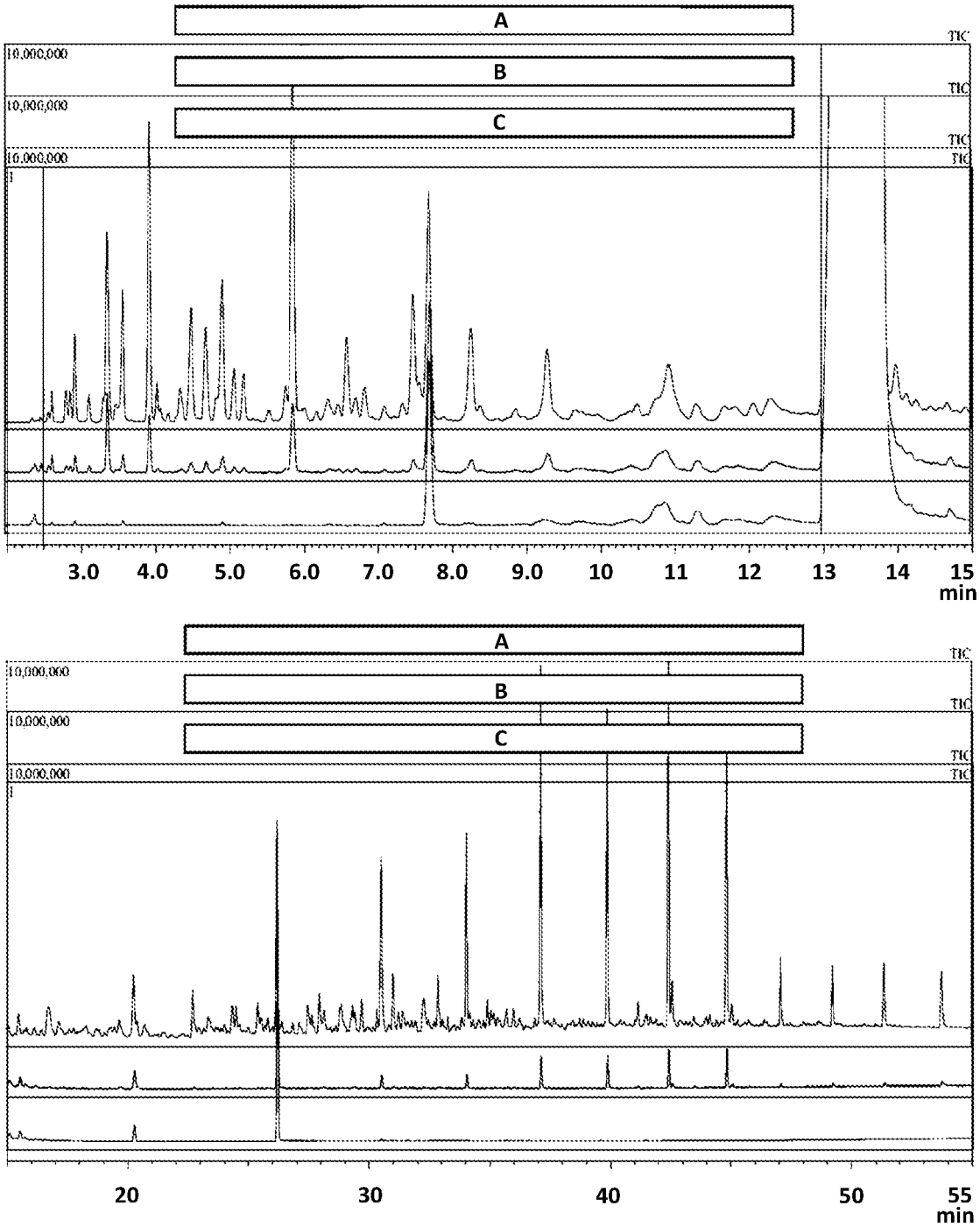
FIG. 19 Effect of lignin-oil HDO on upgraded product oil composition.

FIG. 19 shows GC chromatograms of the two experiments with HDO of lignin oil compared to the blank HDO of decane solvent (A: HDO of 39 g lignin-oil at 340° C.; B: HDO of 3.8 g lignin-oil at 340° C.; C: HDO of Decane at 340° C.). The composition of the two lignin oils subjected to HDO is similar despite being processed under vastly different conditions (one was exposed to a total of 28 hours thermal exposure while the other was just 4 hours). The results indicate seemingly complete deoxygenation and hydrogenation of aromatic species to cyclic aliphatics and a fossil fuel like composition of the resulting product.

Figure 20:
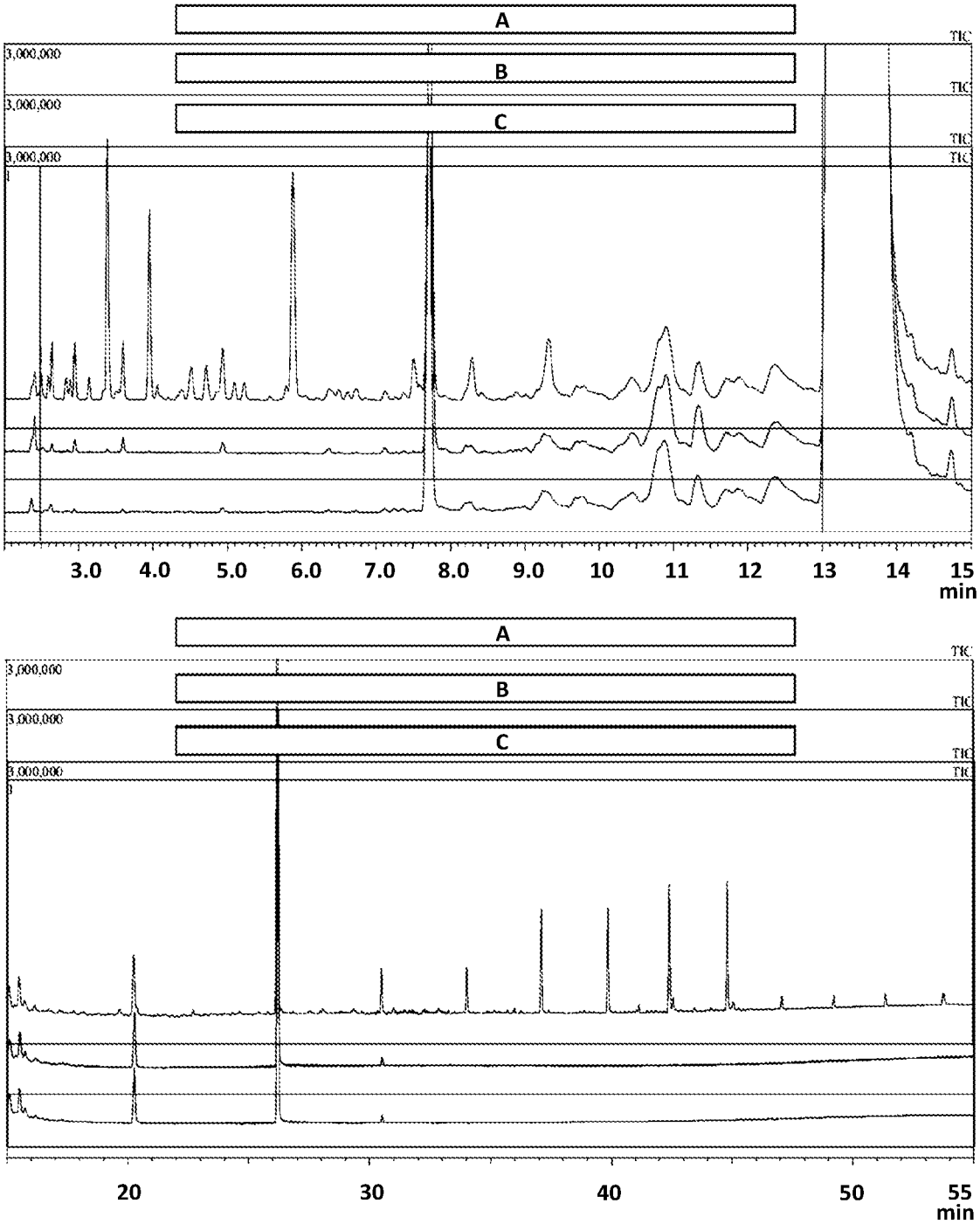
FIG. 20 Effect of HDO on Decane solvent composition.

FIG. 20 shows GC chromatograms of decane subjected to HDO and decane straight from the bottle (A: HDO of 3.8 g lignin-oil at 340° C.; B: HDO of Decane at 340° C.; C: Decane from bottle (no HDO)). HDO of lignin oil is also shown. It is clear that the decane solvent is unaffected by the HDO and is therefore a suitable inert filler solvent for the HDO experiments.

Figure 21:
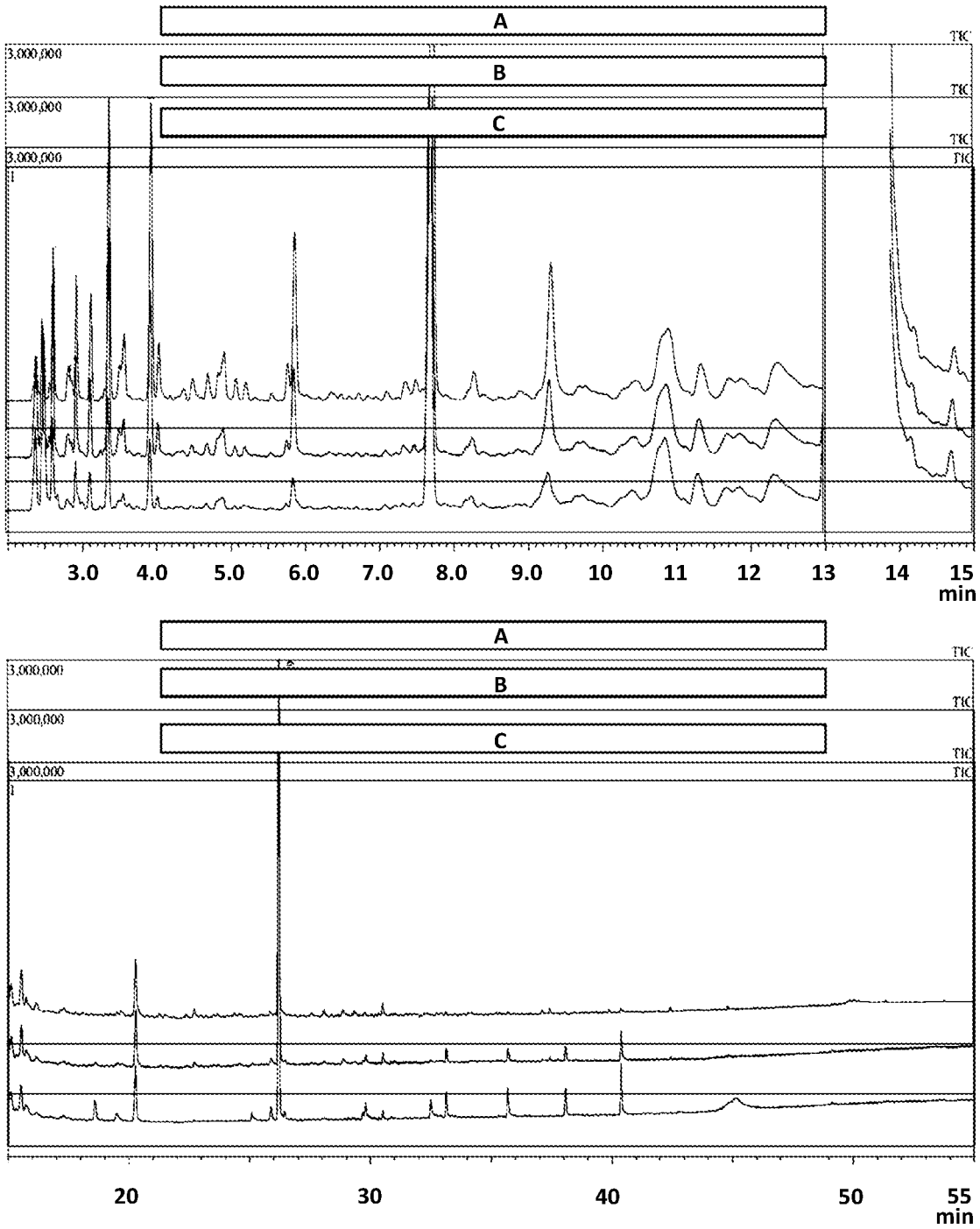
FIG. 21 Effect of wood-oil HDO at different reaction temperatures on upgraded product oil composition.

FIG. 21 shows GC chromatograms of wood-oil subjected to HDO at 300° C., 320° C. and 340° C. (A: HDO of 5.0 g wood-oil at 340° C.; B: HDO of 4.0 g wood-oil at 320° C.; C: HDO of 4.2 g wood-oil at 300° C.). Similarly to HDO of lignin oil exhaustive dexoxygenation and hydrogenation occurs. The same compounds are seemingly found independent on reaction temperature but at the highest reaction temperature the total amount of compounds with lower molecular weight obtained at column times less than 6 minutes are increased whereas the larger molecules at column times longer than 30 minutes are equally decreased.

Figure 22:
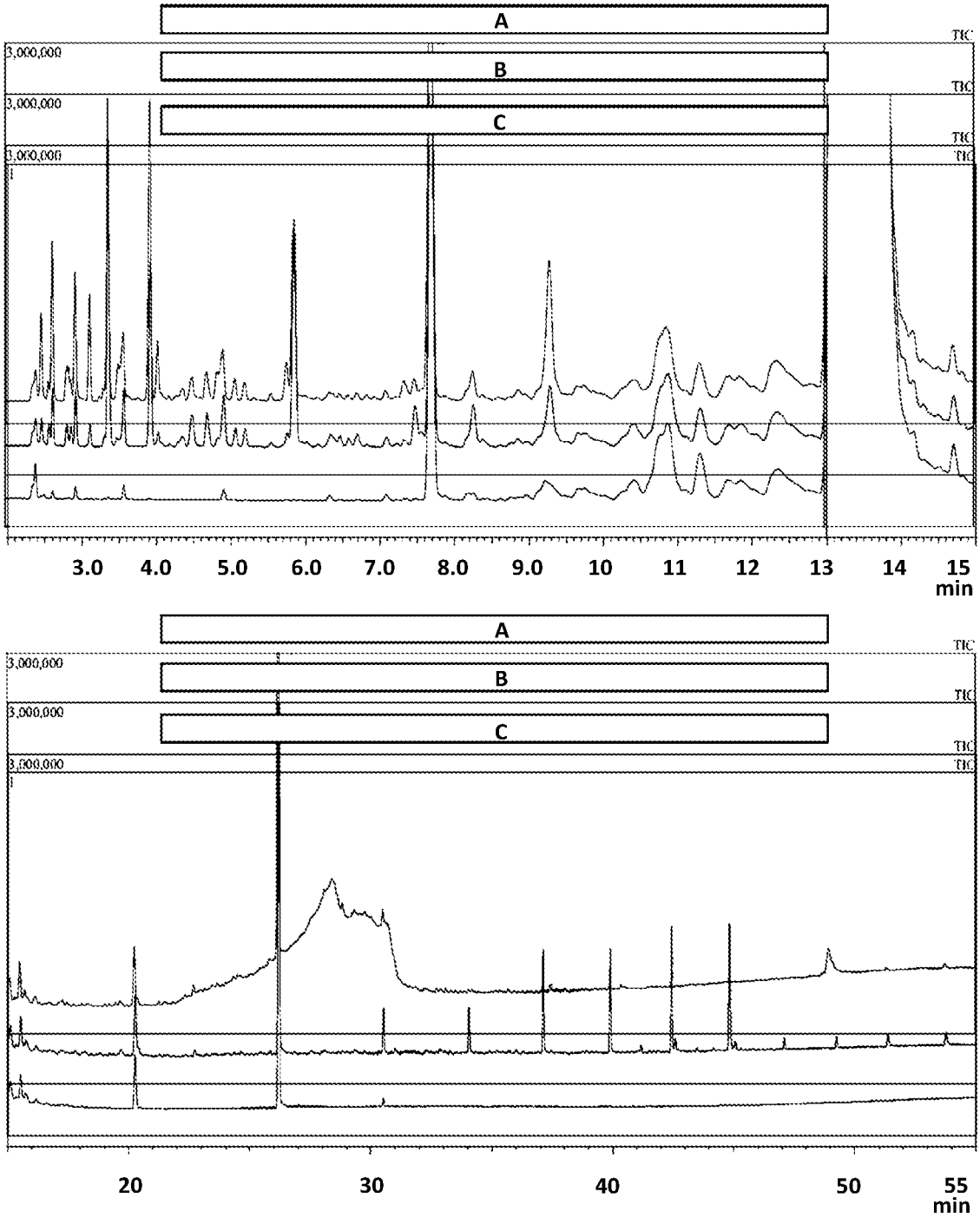
FIG. 22 Comparison of product oil composition after HDO of lignin-oil and wood-oil at similar conditions.

FIG. 22 shows GC chromatograms of lignin-oil and wood-oil both subjected to HDO at 340° C. with decane HDO blank experiment as baseline reference (A: HDO of 5.0 g wood-oil at 340° C.; B: HDO of 3.8 g lignin-oil at 340° C.; C: HDO of Decane at 340° C.). The products of HDO of both lignin- and wood-oil are very similar. Interestingly the lignin-oil HDO yields predominantly functionalized cyclohexanes where wood-oil HDO yield both functionalized cyclohexane species as well as cyclopentane species. The latter is most likely due to the higher content of carbohydrates and C5 sugars in the original beech wood feedstock whereas the lignin rich feedstock used for making the lignin-oil is relatively more rich in aromatics stemming from lignin.

13. Prophetic Example—Continuous Liquefaction

Experiments with liquefaction of biomass in recycled oil solvent and with an alcohol reactant can be conducted on a small scale continuous setup. These experiments provide a method for determining the appropriate ratio of bio-oil or bio-oil-biomass slurry to ethanol reactant added that is sufficient to maintain an ethanol density of at least 17 kg/m3 within the thermal reactor during steady state operation.

The setup consists of three connected parts: (1) feed pump, (2) a heated and subsequently cooled reactor pipe and (3) a non-stirred collection tank with a purge.

(1) A specially designed feed pump system comprising of a thick walled stainless steel cylinder with a free moving piston inside serves a continuous supply a prefilled reactant mixture to the system. An HPLC pump supplies water at a feed rate of up to 10.0 ml/min effectively moving the free piston and displaced volume equals the feed flow rate. A pressure relief system is mounted on the water inlet side adjusted to go off at 150 bar. The pump volume is 490 ml. The water side of the pump is equipped with both a digital and an analog pressure read out. The pump temperature is equally digitally measured. A feed mixture of the following is used for experiments: 100-500 ml of oil, 10-200 g of biomass and 10-150 g of alcohol, e.g. ethanol. The pump can be replaced with any pump capable of feeding a slurry of biomass, alcohol and bio-oil and mixing ratios are retained.

(2) A feed mixture is pushed continuously through an up to 25 mm wide heated pipe section to which pressure sensors are. The temperature is digitally logged before and after the reactor pipe. A heating jacket is controlled with a PID controller and keep the heated pipe reactor at a set point of between 300 and 400° C. The reactor pipe can be 10-50 cm in length. Immediately downstream the reactor the pipe is cooled to room temperature or below (e.g. by running through an ice bath.

(3) A stainless steel collection tank collects the cooled reaction products comprising of gas, liquid and solids. Flow is coming in from the bottom. The volume is 490 ml. At the top gasses exit through a back pressure regulator adjusted prior to start of an experiment (set point can be from 0 to 100 bar) and this controls the reaction pressure during an experiment.

Valves are mounted strategically to allow for multiple collection tanks and evacuation of one collection tank during the filling of another. Equally valves can be mounted immediately downstream the pump to allow for two pump cylinders to be mounted effectively allowing for fully continuous operation indefinitely as one pump cylinder can be manually refilled as another one is being evacuated/emptied through the reactor.

Experiments are conducted by preparing first a slurry feed mixture. The feed pump is filled with ethanol (or any other alcohol), a biomass (e.g. wheat straw or saw dust) and bio-oil (e.g. real recycled product oil or a startup model oil compound such a wood tar creososte or gasification tar or similar) prior to each experiment. The closed system is then pressurized and backpressure regulator setting adjusted for the desired set point.

Continuous experiments can be conducted where the first step is ensuring a constant stabile temperature of the heated pipe zone by setting a set point (300-400° C.) on the controller and waiting until stable temperature. The temperature is then kept constant throughout an experiment. The cooling is equally turned on and kept on (or in the case of using ice, fresh is used). When a stable temperature of the heated reactor zone is achieved and the cooling has been turned on an experiment can be conducted. Now the contents of the feed pump are continuously pushed at a known rate (setting of water HPLC pump) through the reactor pipe and into the collection tank. Gasses formed and N2 are continuously purged through the back pressure regulator to ventilation. Optionally these gasses can be led to gas analyzers. The pressure throughout the system (feed pump, reactor pipe and collection tank) is constant at the backpressure regulator setting. The setup is monitored until the flow is stable and ensuring that the pressure drop across the reactor pipe does not increase over time. When the entire liquid/slurry contents of the mixing tank is emptied the experiment is concluded and the heating is shut off, N2 supply is shut off and the gaseous contents (and pressure) in the collection tank is relieved by slowly relieving the pressure downstream. When the pressure gauge reads ambient pressure the collection tank is emptied. The liquid and solid sample collected is subjected to further analyses as described in the procedure for examples 1 through 11. This liquid can be subjected to Karl Fischer titration to determine the water content and GC-MS/FID to identify light organic reaction products and determine the concentration of alcohol reactant in the light fraction. The degree of alcohol consumption/loss can be determined as the difference between quantified mass of ethanol after the reaction and mass of ethanol added prior to reaction. The mass of ethanol solvent after reaction can be quantified by assuming that the mass loss due to handling of reaction products such as during transferring is solely due to loss of light reaction products (water, solvent and other light organics) and can therefore be added to the total mass of isolated products.

These experiments provide a method for determining the appropriate ratio of bio-oil or bio-oil-biomass slurry to ethanol reactant added that is sufficient to maintain an ethanol density of at least 17 kg/m3 within the thermal reactor during steady state operation as determined by repeatable continuous operation without clogging in the reactor. This is determined by a constant pressure drop over the heated reaction zone.

A defined set of reaction conditions shall be used for the first experiment:

(i) Feed mixture comprising 400 g wood tar (model recycle oil), 100 g biomass, and 50 g ethanol;
(ii) Reactor temperature of 350° C.
(iii) Reactor pressure of 50 bar
(iv) Feed rate shall be 5 ml/min or correspond to a residence in the reactor zone of at least 5 minutes The reaction conditions may be changed if steady state cannot be obtained. When steady state has been obtained the following procedure of conducting experiments will be followed where products of reaction are recovered and yields and alcohol consumption are determined for all experiments as described in the above.

The experiment is repeated to verify repeatability.

Based on the determined alcohol consumption the ethanol density inside the reactor is determined for the experiment. The density shall be above 17 kg/m3 if no alcohol is consumed since the reaction pressure is kept at 50 bar. In the case of alcohol consumption the final pressure exerted by the alcohol upon leaving the reactor zone may be so low that it corresponds to a density of less than 17 kg/m3. From the determined quantity of ethanol consumed one can calculate what the final pressure exerted by alcohol at 350° C. with the reactor dimensions used. This pressure is used to determine the density of the alcohol based on empirical data from literature or by comparison to known data collected from batch autoclaves as described in the other examples herein where a fixed quantity of ethanol confined in a vessel of a known fixed volume will exert a fixed repeatable pressure at pressure for a given temperature. If the determined ethanol density is less than 17 kg/m3 a new experiment, or a series of experiments, is conducted at the same reaction conditions but with increasing amounts of ethanol in the feed mixture. Once the quantity of ethanol added is sufficient to reach the density of 17 kg/m3 the final mixing ratio is registered as the minimal amount of ethanol to be added at 350° C. and 50 bar. Next, using this newly obtained mixing ratio, a series of experiments are conducted in which the reaction pressure is reduced and/or increased to similarly determine the minimum amount of ethanol reactant added ad varying pressures. The pressure is reduced to 30 bar, and to 15 bar. One may need to conduct multiple experiments at a larger range of pressures or one may satisfy with a few experiments only if a trend can be observed such as e.g. a linear relationship between reaction pressure and minimum quantity of ethanol added to yield a density of at least 17 kg/m3.

These experiments can equally be conducted at different temperatures.

Furthermore, these experiments can be conducted at varying degrees of biomass to bio-oil ratio, e.g. by adding different quantities of biomass to the feed mixture.

14. Prophetic Example—Continuous Liquefaction

A continuous liquefaction plant similar to the one described herein and the one at Iowa State Univeristy (as described in PhD Thesis by Martin Robert Haverly, "An experimental study in solvent liquefaction", Iowa State University, 2016) can be modified to conduct continuous solvent liquefaction of lignocellulosic biomass using a phenolic and ethanol as described herein. The phenolic solvent represents recycled product bio-oil. Loblolly pine milled to ¾" minus particle size, at moisture content of approximately 8-10 wt % can be used as feedstock in continuous solvent liquefaction experiments. Solids loading will be 25 wt %, with phenolic solvent and ethanol injected in the extruder feeding system. Temperature will be between 280-350° C. Pressure will be 27-48 bar, and residence time will be approximately 25 minutes. Resulting reactor product, which consists of both liquids (biocrude) and solids (char), can be separated off-line. A combination of solvation using acetone and mechanical separation (e.g. filtration and centrifugation) will be used to separate the biocrude from the char. The biocrude, overheads (light condensable products), non-condensable gas and char will be quantified to determine a mass balance. Further separations of the biocrude will be conducted using the pilot plant's existing stripping column to recover a phenolic monomer-rich cut, which will be analytically evaluated for future use as recycled bio-oil solvent. The overheads will be characterized using Karl Fischer titration to determine water production and GC-Mass Spec to quantify ethanol recovery. The biocrude will undergo elemental analysis to determine carbon, hydrogen, nitrogen and oxygen contents; bomb calorimetric analysis to determine higher heating value; Gel Permeation Chromatography to determine relative molecular weight distribution; and Thermogravimetric analysis to estimate boiling point ranges of the biocrude constituents. The results from these studies will be compared to those previous studies on the preexisting pilot under the same operating conditions to document the effect of the addition of ethanol.

The embodiments and examples shown are exemplative only and not intended to limit the scope of the invention as defined by the claims.

PATENT REFERENCES CITED

WO2012/005784
WO2016/113280
WO2019/053287
WO2019/158752
U.S. Pat. No. 4,759,841
U.S. Pat. No. 7,425,657.

NON-PATENT REFERENCES CITED

Bazaev, A. et al., "PVT measurements for pure ethanol in the near-critical and supercritical regions," International Journal of Thermophysics (2007) 28(1):194.

Belkheiri, T. et al. "Hydrothermal Liquefaction of Kraft Lignin in Subcritical Water: Influence of Phenol as Capping Agent," Energy Fuels (2018) 32:5923-5932.

Castello, D. et al. "Continuous Hydrothermal Liquefaction of Biomass: A Critical Review," Energies (2018) 11, 3165.

Jensen, C. et al. "Fundamentals of Hydrofaction™: Renewable crude oil from woody biomass," Biomass Cony. Bioref. (2017) 7:495-509.

Nielsen, J. B. et al. "Solvent consumption in non-catalytic alcohol solvolysis of biorefinery lignin," Sustainable Energy Fuels, 2017, 1, 2006-2015

Pang, S. "Advances in thermochemical conversion of woody biomass to energy, fuels and chemicals," Biotechnology Advances (2019) 37:589-597.

The invention claimed is:

1. A method for production of bio-crude oil comprising the steps of:

(i). Providing lignocellulosic biomass, and (ii). Subjecting said biomass to thermochemical treatment at temperature between 25° and 450° C. for residence time between 1 and 120 minutes as a slurry formed with re-circulated product oil obtained from previous thermochemical treatment of lignocellulosic biomass to which slurry is added a short-chain alcohol reactant in an amount corresponding to between 2% and 150% of the slurry dry weight, wherein the ratio of biomass to re-circulated product oil is within the range 1:1 and 1:5 w/w and the ratio of biomass to added alcohol is within the range 1:9 and 5:1 w/w, and wherein thermochemical treatment is conducted under conditions where the partial pressure of the alcohol reactant is lower than 60 bar.

2. The method of claim 1 wherein the alcohol reactant is ethanol.

3. The method of claim 1 wherein the recycled product oil obtained from previous thermochemical treatment of similar biomass is derived from distillation of whole product oil and has a boiling point within the range 200-400° C.

4. The method of claim 1 further comprising use of a distillation system to separate reaction products into desired fractions.

5. The method of claim 4 wherein some fractions are used in the process method as recycled product oil obtained from previous thermochemical treatment of similar biomass while the remaining fractions are filtered and saved as final product oil for further processing.

6. The method of claim 1 wherein thermochemical treatment is conducted in the absence of an effective amount of added catalyst.

7. The method of claim 1 conducted as a batch process.

8. The method of claim 1 conducted as a continuous process.

9. The method of claim 8 wherein a portion of product oil is removed as final product oil for further processing while a portion is recycled in the process as recycled product oil.

10. The method of claim 9 wherein the portion recycled has a boiling point within the range 200° C.-400° C.

11. The method of claim 9 wherein the portion recycled is within the range 50 to 95 wt. % and the portion removed as final product oil is within the range 5 to 50 wt. %.

12. The method of claim 9 wherein the ratio of biomass to added alcohol is selected as to maintain an alcohol reactant density at steady state of at least 17 $kg/m^3$.

13. The method of claim 9 wherein the ratio of biomass to added alcohol is selected as to maintain an alcohol reactant density at steady state within the range between 2 to 52 $kg/m^3$.

14. The method of claim 9 wherein the recycled product oil obtained from previous thermochemical treatment of similar biomass is cooled to 200° C. or lower prior to use in the process.

15. The method of claim 9 wherein the recycled product oil obtained from previous thermochemical treatment of similar biomass is mixed with the lignocellulosic biomass and pumped into a pressurized system before adding alcohol reactant.

16. The method of claim 9 wherein unspent alcohol reactant is recovered from product oil and re-used in the process.

17. The method of claim 1 further comprising the steps of recovering product oil and subjecting it to further processing.

18. The method of claim 17 wherein further processing comprises hydrodeoxygenation.

19. The method of claim 17 wherein product oil is mixed and co-processed with petroleum refinery streams.

20. The method of claim 17 wherein the product oil may be recovered in a manner that does not separate unspent alcohol reactant whereby all unspent alcohol reactant is included within the product oil.

21. The method of claim 20 wherein product oil is recovered in such manner that unspent alcohol reactant comprises between 0.1 and 15 wt. % of product oil.

22. The method of claim 1 wherein thermochemical treatment is conducted at temperature between 30° and 400° C.

23. The method of claim 1 wherein the alcohol reactant is methanol.

* * * * *